US009879486B2

(12) United States Patent
Richardson et al.

(10) Patent No.: US 9,879,486 B2
(45) Date of Patent: Jan. 30, 2018

(54) PORTABLE PIPE HANDLING SYSTEM

(71) Applicant: Warrior Rig Technologies Limited, Calgary (CA)

(72) Inventors: Allan Stewart Richardson, The Woodlands, TX (US); Monte Neil Wright, Calgary (CA)

(73) Assignee: Warrior Rig Technologies Limited, Calgary (CA)

( * ) Notice: Subject to any disclaimer, the term of this patent is extended or adjusted under 35 U.S.C. 154(b) by 0 days.

(21) Appl. No.: 14/792,311

(22) Filed: Jul. 6, 2015

(65) Prior Publication Data

US 2016/0002988 A1 Jan. 7, 2016

Related U.S. Application Data

(63) Continuation of application No. 13/573,878, filed on Oct. 11, 2012, now Pat. No. 9,157,286.

(60) Provisional application No. 61/545,989, filed on Oct. 11, 2011.

(51) Int. Cl.

| | |
|---|---|
| ***E21B 19/15*** | (2006.01) |
| ***E21B 19/14*** | (2006.01) |
| ***E21B 19/16*** | (2006.01) |

(52) U.S. Cl.

CPC ..... *E21B 19/14* (2013.01); *E21B 19/155* (2013.01); *E21B 19/16* (2013.01)

(58) Field of Classification Search

CPC ..... E21B 19/14; E21B 19/15; E21B 19/155
USPC ..... 414/22.51–22.71
See application file for complete search history.

(56) References Cited

U.S. PATENT DOCUMENTS

| | | | | |
|---|---|---|---|---|
| 2,776,058 | A * | 1/1957 | Stone | E21B 19/14 414/22.69 |
| 2,867,338 | A * | 1/1959 | Simmonds | B66C 23/36 198/411 |
| 3,750,898 | A | 8/1973 | Ancey et al. | |
| 6,343,892 | B1 | 2/2002 | Kristiansen | |
| 6,695,559 | B1 | 2/2004 | Pietras | |
| 6,854,520 | B1 * | 2/2005 | Robichaux | E21B 19/07 166/380 |
| 7,246,983 | B2 | 7/2007 | Zahn et al. | |
| 7,832,974 | B2 | 11/2010 | Filowski et al. | |
| 2003/0155154 | A1 * | 8/2003 | Oser | E21B 19/155 175/52 |
| 2004/0136813 | A1 * | 7/2004 | Pietras | E21B 19/00 414/22.51 |
| 2007/0193750 | A1 | 8/2007 | Wright et al. | |
| 2008/0253866 | A1 | 10/2008 | Lops et al. | |
| 2009/0136326 | A1 | 5/2009 | Angman | |
| 2009/0159294 | A1 | 6/2009 | Abdollahi et al. | |
| 2009/0185883 | A1 * | 7/2009 | Wright | E21B 19/20 414/22.54 |

(Continued)

*Primary Examiner* — Anna M Momper
*Assistant Examiner* — Lynn E Schwenning
(74) *Attorney, Agent, or Firm* — Oyen Wiggs Green & Mutala LLP

(57) ABSTRACT

A portable pipe handling apparatus and method includes providing a support structure adapted to support a pipe stand along a pipe stand building axis associated therewith, and inclining the pipe stand building axis so that an upper end of the axis is adjacent a top drive in a drilling rig mast and so that the pipe stand translation trajectory which is substantially co-axial with the pipe stand building axis intersects a hand-off window between the top drive and the pipe stand building axis.

23 Claims, 42 Drawing Sheets

(56) References Cited

U.S. PATENT DOCUMENTS

| | | | | |
|---|---|---|---|---|
| 2009/0257848 | A1 | 10/2009 | Stroshein et al. | |
| 2009/0279987 | A1* | 11/2009 | Jantzen | E21B 15/04 414/22.53 |
| 2010/0135750 | A1 | 6/2010 | Tarique | |
| 2011/0079434 | A1 | 4/2011 | Belik et al. | |

* cited by examiner

Working Position

Retracted Position

Retraction steps, Tripping Out, tabulated to show simultaneous operations (TD means Top Drive):

| TD Actions | Robotic Arm | Floor Tongs/Wrench |
|---|---|---|
| Hoist the drill string | Once the TD is high enough, deploy the Robotic Arm Gripper around the pipe, but don't grip. | Deploy around well center. |
| Set the drill string in the slips at the floor | Loosely close the Robotic Arm Gripper to contain (but not grip) the pipe. | |
| Open the TD elevators.<br>Retract the TD clear of well center.<br>Travel down. | | Break-out & spin-out the stand |
| Continue to travel down | Full grip with the Robotic Arm.<br>Raise the stand to unstab from the drill string in the slips.<br>Transfer the stand to the racking board. | Withdraw from the well center area. |
| Extend the TD back to well center once the stand is clear.<br>Continue to travel down to the floor. | Rack the stand. | |
| Close the TD elevators.<br>Hoist. That completes the cycle. | | |

Fig. 32

PORTABLE PIPE HANDLING SYSTEM

CROSS REFERENCE TO RELATED APPLICATIONS

This application is a continuation of U.S. patent application Ser. No. 13/573,878 filed 11 Oct. 2012, which claims priority to U.S. Provisional Patent Application Ser. No. 61/545,989 filed Oct. 11, 2011, which is hereby incorporated by reference herein in its entirety. Priority is claimed to this earlier-filed application under 35 U.S.C. § 120.

FIELD OF THE INVENTION

This invention relates to the field of pipe handling systems for drilling rigs and in particular to a portable pipe handling system including a pipe handler for tripping in and out of the well string, and for the make up and delivery of pipe stands on a portable pipe handling system which is positionable adjacent a drilling rig mast and substructure for delivery of the pipe stand to a top drive or the rig floor.

BACKGROUND OF THE INVENTION

Conventionally, drilling tubulars are transported in single lengths. A single length of tubular is for example 31 feet in length. Tubulars can however be used on a top drive-equipped drilling rig in triple lengths, that is, in lengths which are for example 93 feet long. Such combined lengths of tubulars are referred to as pipe stands. For efficiency during drilling, it is desirable to combine the single tubulars into for example triple length pipe stands off the critical path of the operation of the drilling rig so to not interfere with the drilling operation.

Moving pipe stands onto and off from the critical path of the drilling operation for tripping operations is often done with a robotic or at least power-assisted manipulating device, which at least in part replaces, or mechanizes or automates the manual function of members of the drilling rig crew referred to as derrickmen.

An associated part of the tripping operation is placing made up pipe stands into a storage rack mounted on the derrick mast. These racks are sometimes referred to as racking boards. Pipe stands must be manipulated into, and retrieved from the racking board during tripping operations. Numerous pipe racking systems have been developed and are available in the industry. For example, applicant is aware of pipe racking systems which are commercially available from National Oilfield Varco also referred to as NOV, Aker and Weatherford. All of these pipe racking systems are highly integrated, for example, integrated structurally, hydraulically, and/or electrically, into the drilling rig. Most of these are practical only for offshore applications.

Drilling rigs for use on land, referred to as land rigs, have additional mobility requirements, cost constraints and service access challenges. Consequently, in applicant's view, it is desirable to have a racking system for land rigs which is: (a) independently transportable, that is, transportable independently of the land rig; (b) relatively fast and easy to rig up and down; (c) applicable to a wide range of land rigs without significant customization or interface design, to enable manufacturing economies of scale and economy/flexibility of application, for example, temporary use, rental, shared use among rigs, provision as a separately contracted rig accessory; and (d) relatively easily and safely serviceable.

Numerous systems of which applicant is aware have been used for offline building of pipe stands, referred to as stand-building, wherein the stand-building is done either horizontally, or vertically, or for example built vertically in a mousehole. However, in the prior art stand-builders the following limitations or drawbacks are encountered: some stand-builders can only assemble doubles, that is, pipe stands having only two tubulars, some stand-builders require an unconventionally deep mousehole on every well, and also, mousehole-based stand-building systems require manual handling operations within close proximity of the rotating pipe at well center which is a safety concern; and some stand-builders cannot pass the assembled pipe stand directly to the top drive elevators, requiring an additional pipe stand transfer step.

SUMMARY OF THE INVENTION

It is an object to provide an improved pipe handling system which lends itself well to assisting land-based oil and gas drilling rigs. For example conventional rigs may not have been originally supplied with pipe handling equipment. Thus such rigs may not be well adapted for tripping and for pipe stand make up, delivery of pipe stands into the pipe racking board, for assisting in the initial make up, break down and re-make up of new pipes which must have their threaded tool joints spun, initially torqued, released then re-torqued, and for delivery of pipe stands to the top drive elevators. Thus a portable pipe handling system would be useful in such cases for example during start up, where the racking board may be filled with pipe stands ready to use and supported vertically in the racking board, where each pipe stand has been made up and delivered by the portable pipe handling system according to one aspect of the present invention, and thereafter, during so-called tripping-in or tripping-out of the pipe string the pipe stands are efficiently tripped in and out of the well. Pipe stands may be efficiently made up and delivered to the top drive or removed from the top drive and broken down or moved in and out from the racking board to and from well center using the present invention lending flexibility, efficiency and safety to the operation of the rig. In this invention, portability advantageously includes a minimal interface between the rig and the portable pipe handling system, where minimizing the interface includes minimizing mechanical, electrical and hydraulic interface, in other words where the pipe handling system is largely independent of the rig.

In summary, the portable pipe handling system according to one aspect of the present invention may be characterized as including for use in conjunction with a drilling rig having a drilling mast aligned with a well center and mounted atop a rig sub-structure, a support structure adapted to support a pipe stand along an inclined pipe stand building axis, wherein the pipe stand building axis is inclined so that a pipe stand translation trajectory which is substantially co-axial with the pipe stand building axis intersects a hand-off window between the drilling mast and the pipe stand building axis.

The system may also include a base coupled to the support structure, and a tubular handler cooperating with the base and the support structure, wherein the tubular handler is adapted to deliver a tubular between the base and the stand building axis. The support structure may include a pipe stand joint thread rotator such as a wrench, tong or spinner, and a pipe stand holder such as an elevator, roller, slip, clamp or guide, on the pipe stand building axis, wherein the pipe stand holder cooperates with the support structure so that the pipe stand is held stationary on the pipe stand building axis or is translated along the pipe stand translation trajectory.

In one embodiment, the support structure includes a pipe handler mast, for example where the mast is on the stand building axis. The base may include a catwalk. The mast may be pivotally coupled to the catwalk so that the inclination of the pipe stand building axis is adjustable.

The tubular handler may include a tubular transport arm having a leading end and an opposite trailing end, wherein the tubular transport arm is translatable along the base and along the pipe stand building axis, for example, along the pipe handler mast. An actuator may be provided which cooperates between the base and the support structure to actuate the translation of the tubular transport arm along at least the base.

Advantageously, during the translation of the tubular transport arm the tubular transport arm is rotated in a substantially vertical plane containing the base and the pipe handler mast between a substantially horizontal position substantially parallel to the base and an inclined position substantially parallel to and adjacent the pipe handler mast.

Further advantageously, an anti-sway structure is mounted to the support structure and adapted for stabilizing the support structure to the drilling mast or rig sub-structure. Preferably the anti-sway structure is adapted to substantially only react lateral side loading on the support structure, lateral relative to the support structure, to the drilling mast or rig sub-structure, that is, substantially without reacting vertical loading into the drilling mast or rig sub-structure.

In a preferred embodiment a robotic pipe handler is mounted to an upper end of the support structure, for example to the upper end of the pipe handler mast, to transfer the pipe stand between at least the pipe stand building axis and substantially the well center. The robotic pipe handler reacts substantially all vertical loading thereon to the support structure.

In one embodiment the base includes a catwalk and the tubular transport arm comprises a leading arm which includes the leading edge, and a trolley which includes the trailing edge. In a preferred embodiment the arm is pivotally coupled to the trolley. The leading arm supports one of the tubulars as the rotation of the tubular transport arm rotates only the leading arm, and trolley remains substantially horizontal on the catwalk, and is drawn along the catwalk during the rotation of the leading arm. Again in the preferred embodiment the leading arm is selectively rigidly coupled to the trolley by selective disabling of the pivotal coupling between the leading arm and the trolley so that, when rigidly coupled, the leading arm is substantially co-linear with the trolley during the rotation of the tubular transport arm so that longer objects such as casing may be delivered between the stand building axis and the base.

Advantageously the tubular transport arm further comprises a skate for pushing a tubular towards the leading edge and onto the leading arm ahead of the trolley. The pivotal coupling may be a hinge. The skate may cross the hinge so as to translate along both the trolley and the leading arm.

In one embodiment the mast is pivotable down onto the catwalk for transport.

Advantageously the robotic pipe handler is adapted for tripping pipe stands. The system may further include or be adapted to cooperate with a top drive retractor cooperating with the top drive in the drilling rig to retract the top drive from well center, and wherein the robotic pipe handler and the top drive when in the retracted position cooperate during the tripping to increase tripping speed.

The present invention is also intended to include methods implementing use of the system described herein. For example, and without intending to limit the methods according to the various aspects of the present invention, one pipe handling method may be characterized as including:

(a) providing a support structure adapted to support a pipe stand along a pipe stand building axis associated therewith, and (b) positioning and inclining the pipe stand building axis so that an upper end of the axis is adjacent the top drive in the drilling rig mast and so that the pipe stand translation trajectory which is substantially co-axial with the pipe stand building axis intersects a hand-off window between the top drive and the pipe stand building axis.

By way of further example, the method according to another aspect of the invention may include providing a base for the support structure, positioning the base adjacent the sub-structure, delivering one or more tubulars between the base and the pipe stand building axis for make-up or break-down of a corresponding pipe stand along the pipe stand building axis, and delivering the pipe stand or the tubulars therefrom to a selected position chosen from: the hand-off window, the well center, or the base.

The method may further include providing a robotic pipe handler mounted on the support structure at an upper end of the pipe stand building axis, and manipulating the robotic arm so as to move a pipe stand between any two of the following positions: the well center, the hand-off window, the racking board, the pipe stand building axis. Where the drilling rig includes a top drive retractor, the method may further include retracting the top drive and tripping a pipe stand using the robotic pipe handler so that the tong and robotic arm functions happen simultaneously as the top drive is travelling empty.

BRIEF DESCRIPTION OF THE DRAWINGS

FIG. 32 is a table setting out the steps for top drive retraction and tripping out.

DETAILED DESCRIPTION OF EMBODIMENTS OF THE INVENTION

Figure 1:
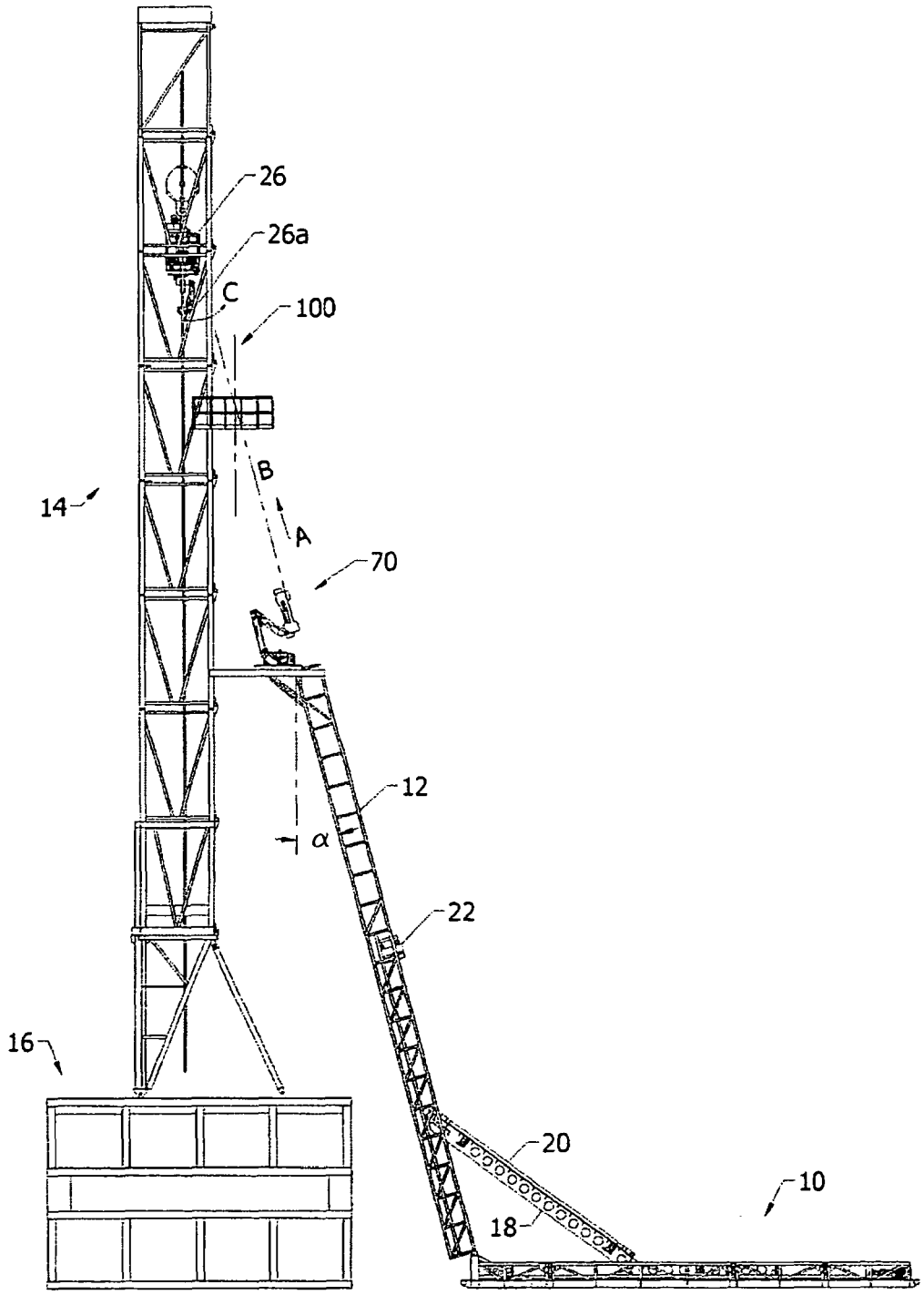
FIG. 1 is, in side elevation view, a simplified illustration of a drilling rig including mast and substructure having the pipe handling system including catwalk and mast according to one embodiment of the present invention positioned so that the trajectory of a pipe stand being elevated from the mast brings the top of the pipe stand to the top drive within the rig mast.
Figure 2:
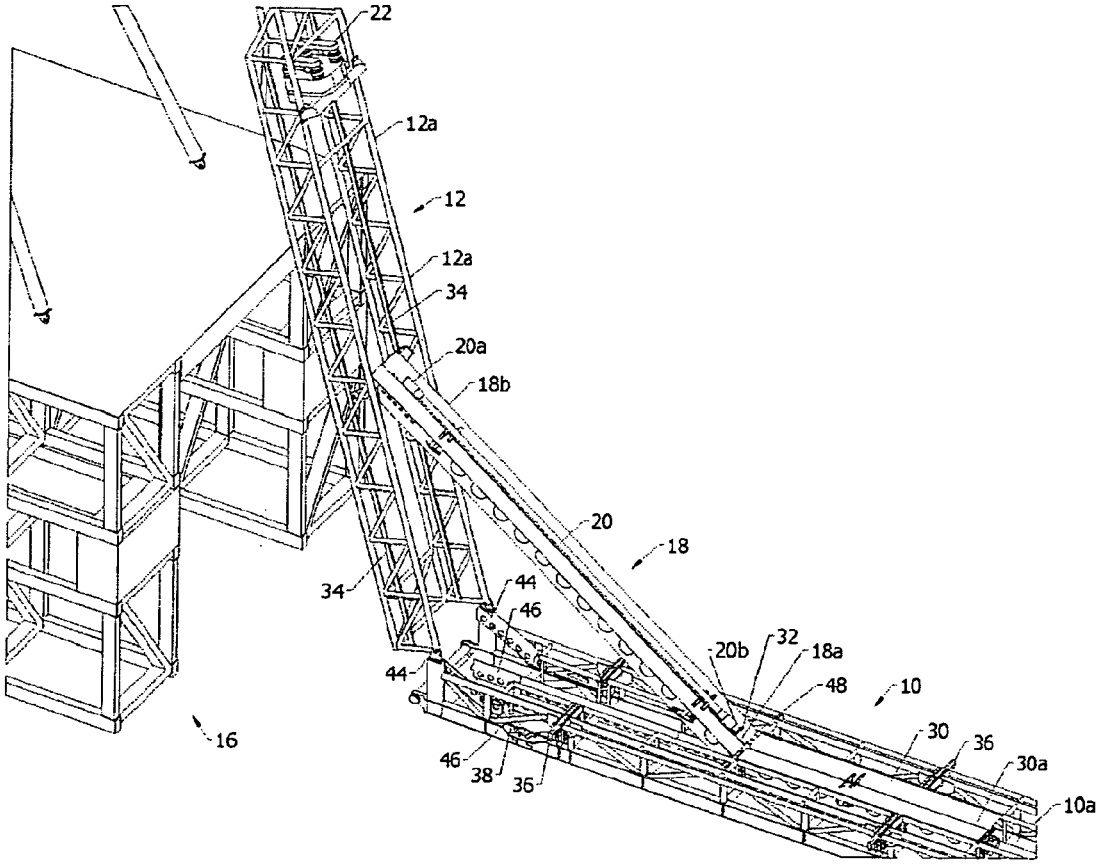
FIG. 2 is a partially cut away perspective view of FIG. 1 showing the lower end of the pipe handling system mast mounted to the catwalk on the ground and showing the tubular transport arm at an intermediate position while being hoisted from the horizontal to its fully inclined position within the base of the pipe handling system mast.
Figure 3:
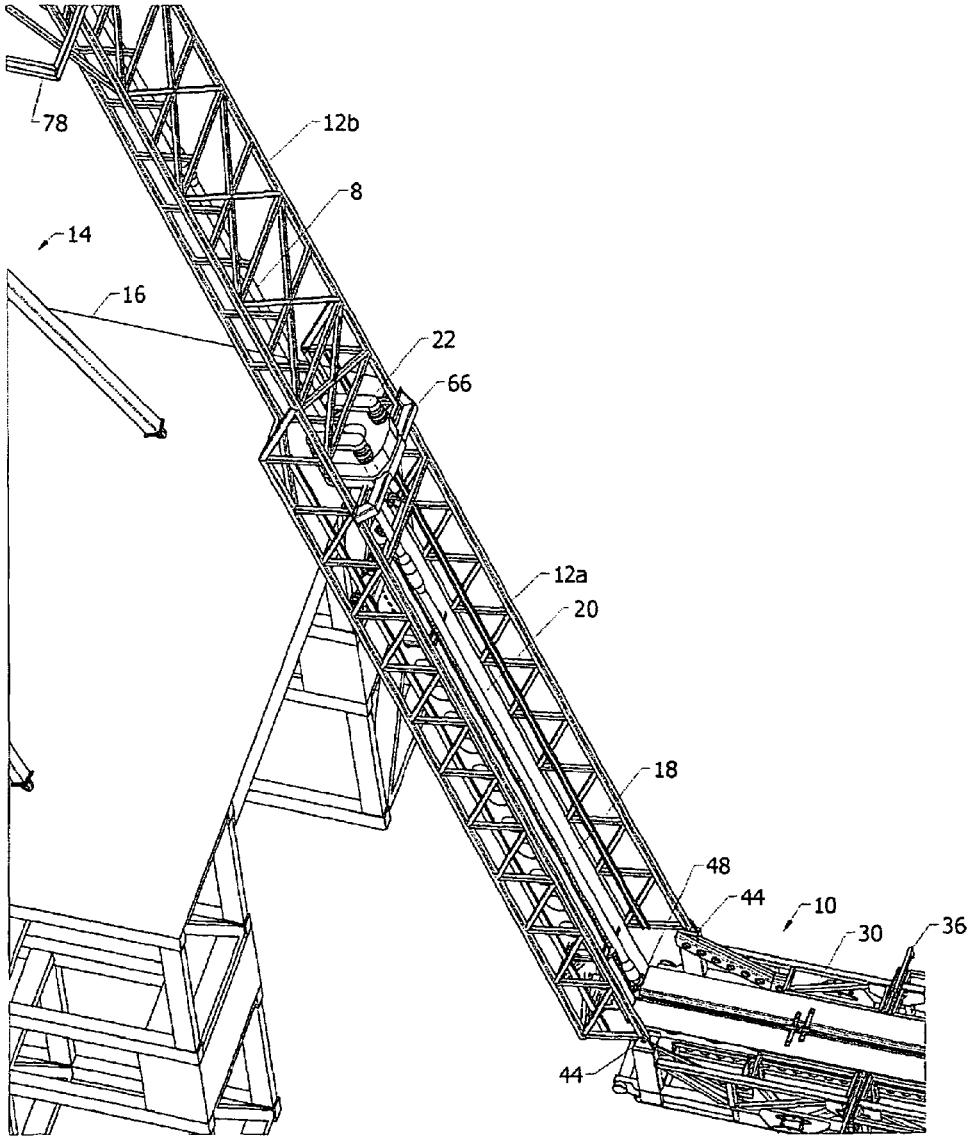
FIG. 3 is substantially the perspective view of FIG. 2 wherein the tubular transport arm has been elevated into its inclined position within the base of the pipe handling system mast.
Figure 4:
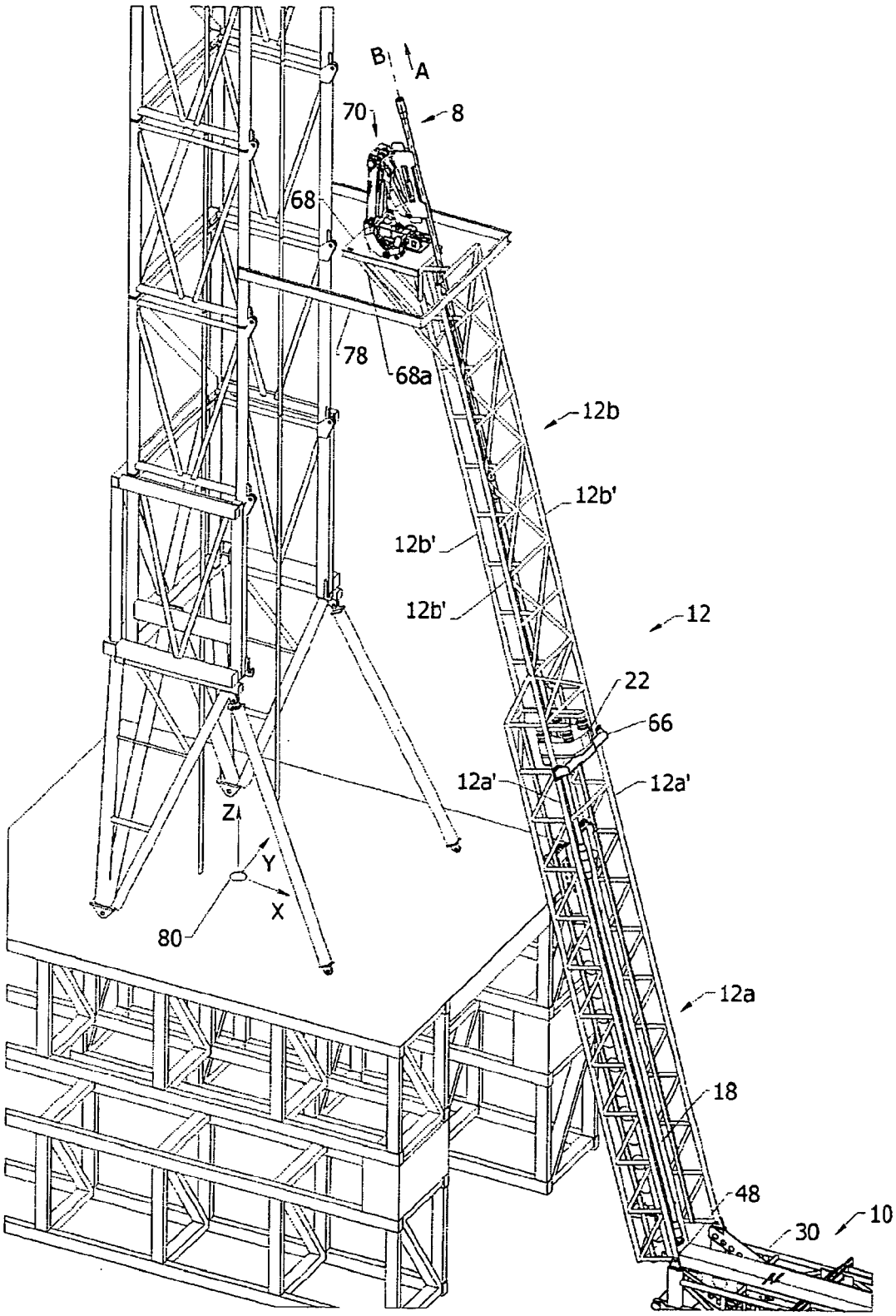
FIG. 4 is the perspective view of FIG. 3 showing the entire pipe handling system mast adjacent the drilling rig mast and substructure.
Figure 5:
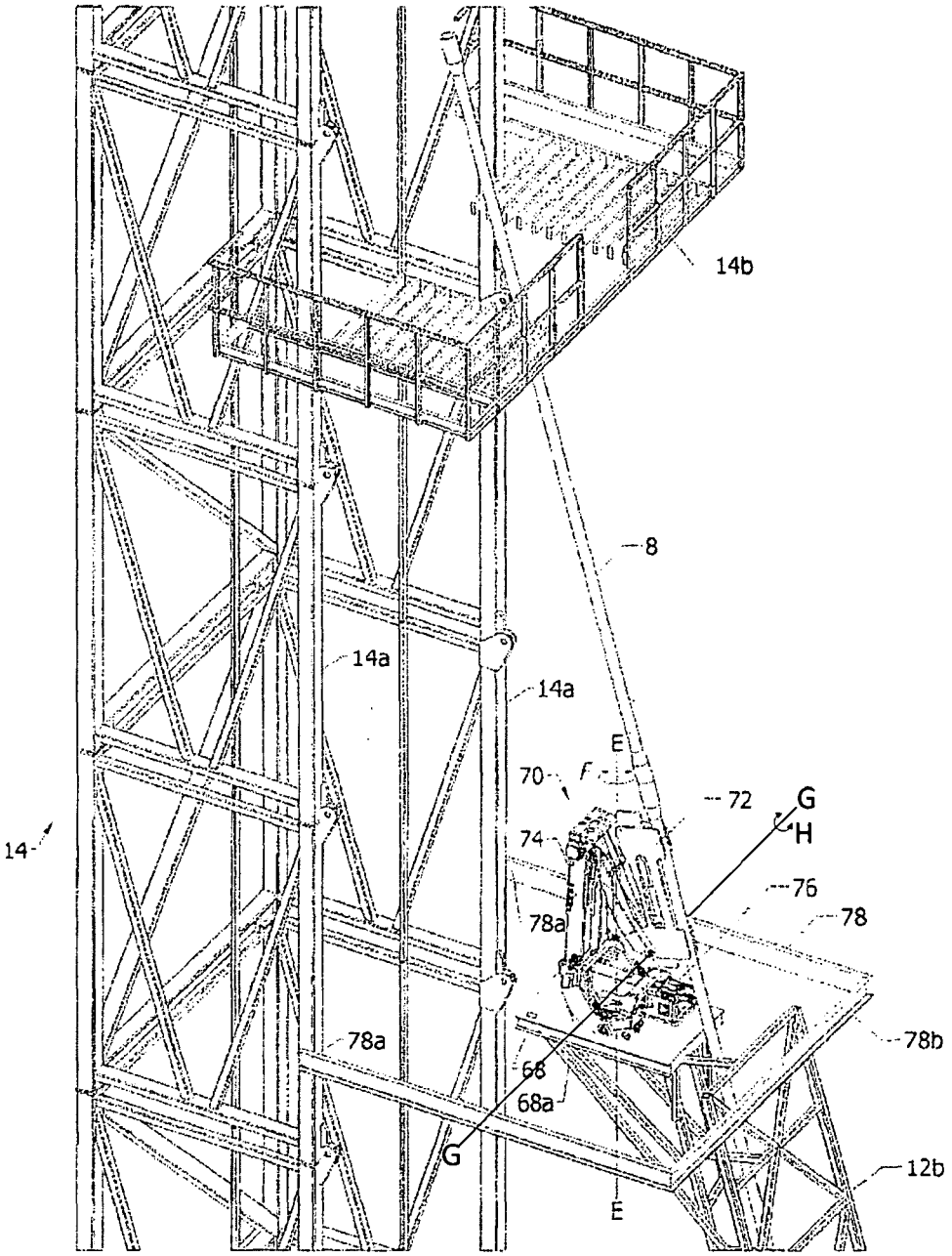
FIG. 5 is substantially the perspective view of FIG. 4 showing a close up of the upper end of the pipe handling system mast and including a robotic arm according to one embodiment for presenting a pipe stand upwardly into the racking board of the drilling rig mast.
Figure 6:
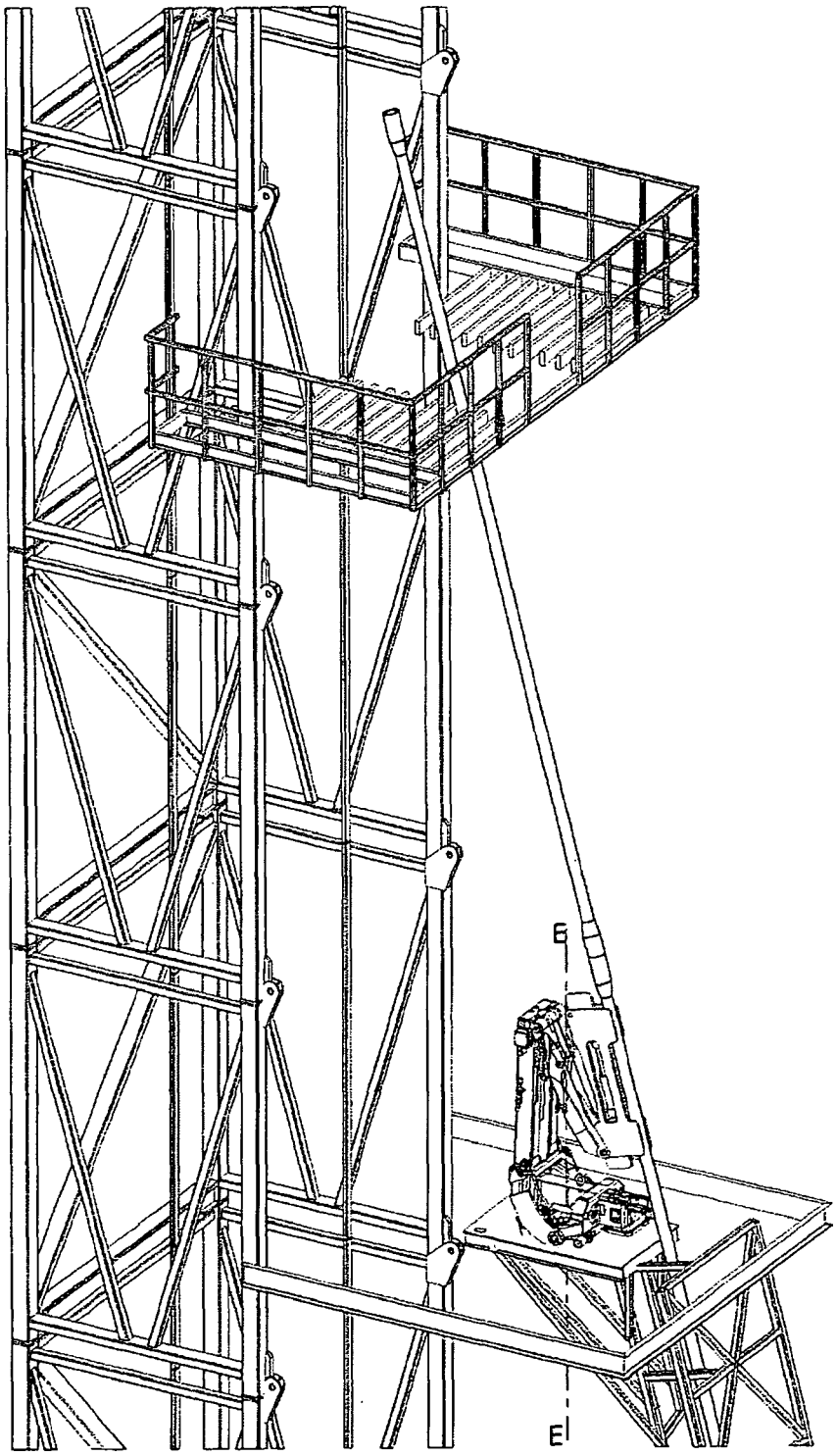
FIG. 6 is substantially the perspective view of FIG. 5 showing the actuation of the robotic arm as the robotic arm is rotated away from the pipe handling system mast.
Figure 7:
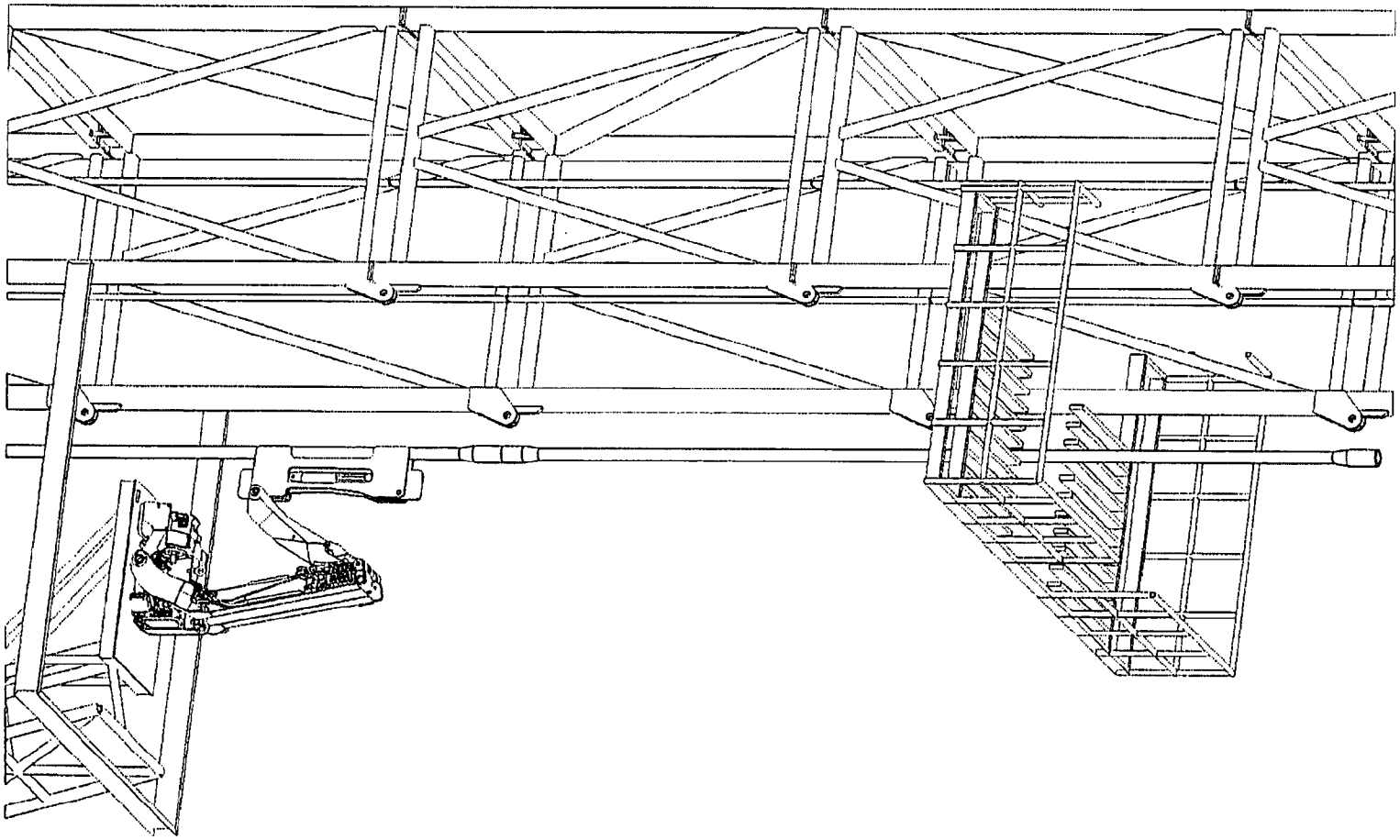
FIG. 7 is substantially the perspective view of FIG. 6 showing the robotic arm having rotated the pipe stand to the vertical and slewed about a vertical axis so as to bring the pipe stand into position for racking in the racking board on the drilling rig mast.
Figure 8:
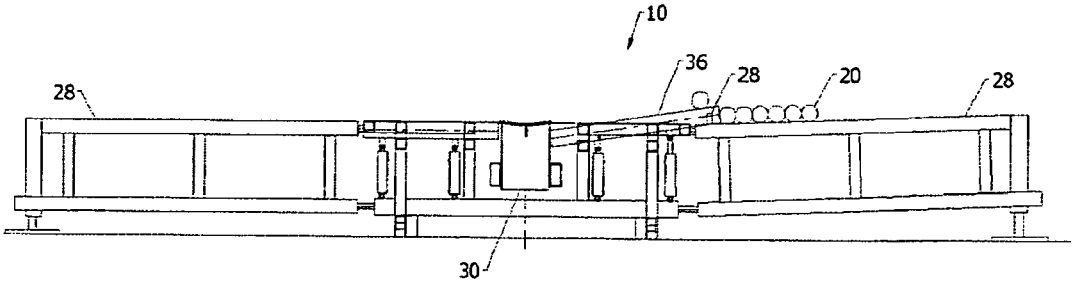
FIG. 8 is an end view of the catwalk and pipe racks as used in one embodiment of the pipe handling system.
Figure 9A:
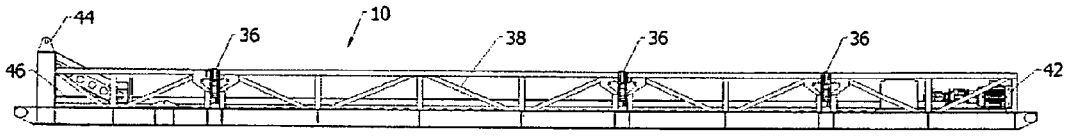
FIG. 9*a* is, in side elevation view, the catwalk of FIG. 8.
Figure 9B:
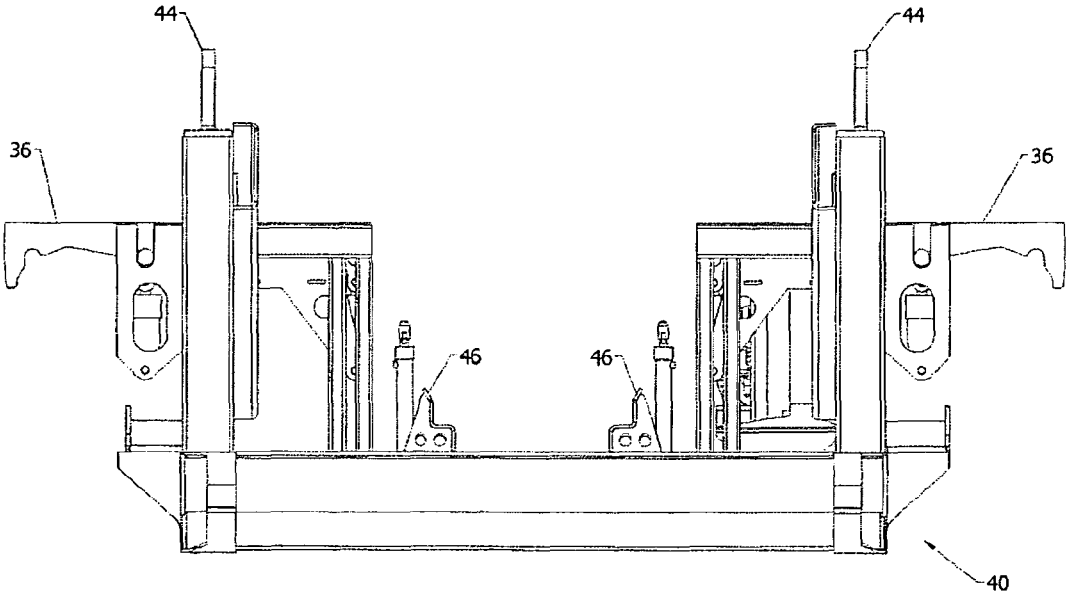
FIG. 9*b* is an end elevation view of the inboard end of the catwalk of FIG. 9*a*.
Figure 9C:
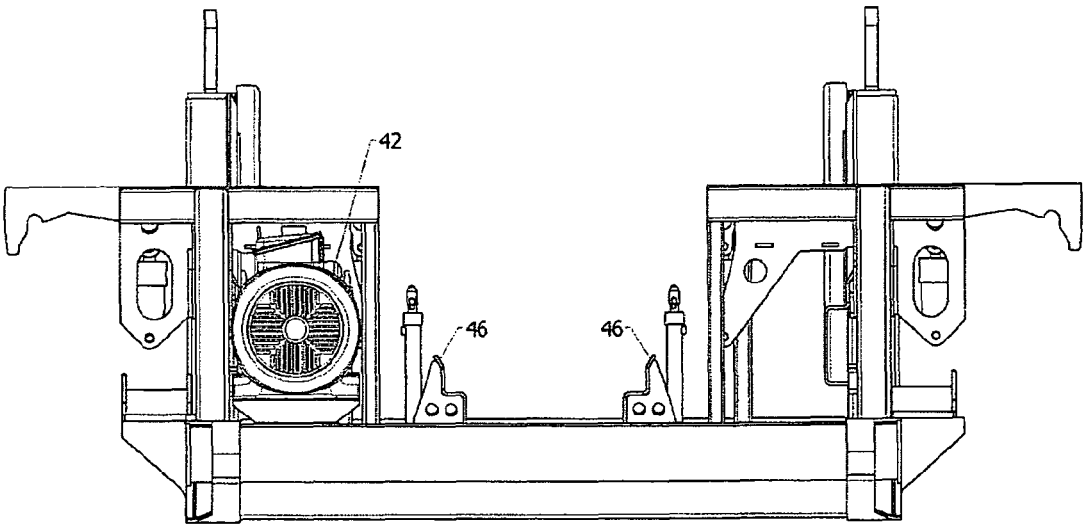
FIG. 9*c* is an end elevation view of the outboard end of the catwalk of FIG. 9*a*.
Figure 10:
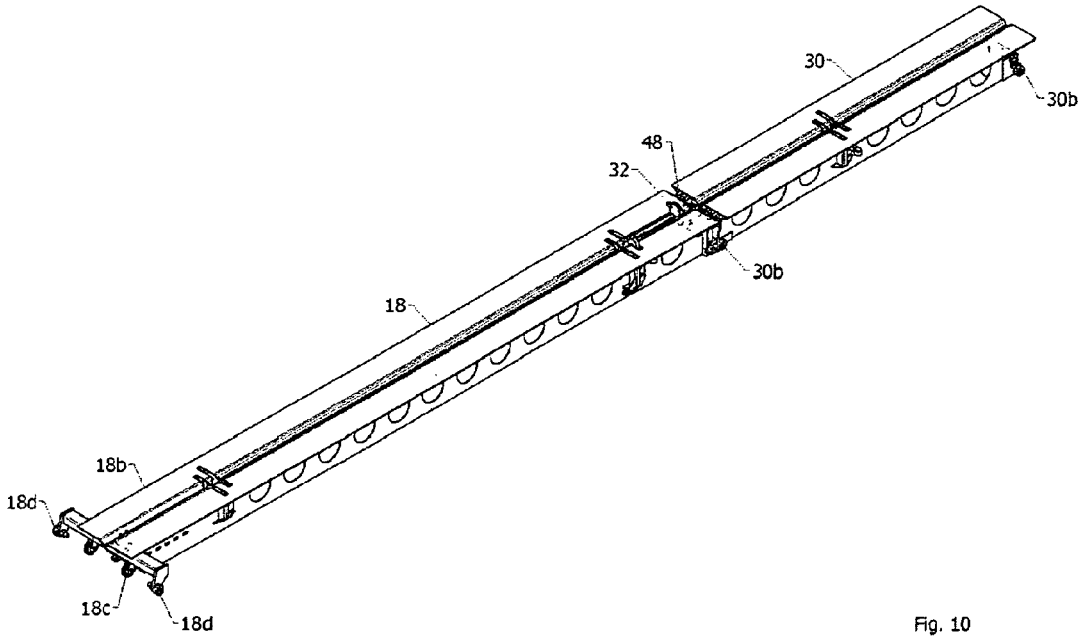
FIG. 10 is, in perspective view from the inboard end, the tubular transport arm and tubular transport trolley according to one embodiment of the pipe handling system showing the single skate in two positions.
Figure 10A:
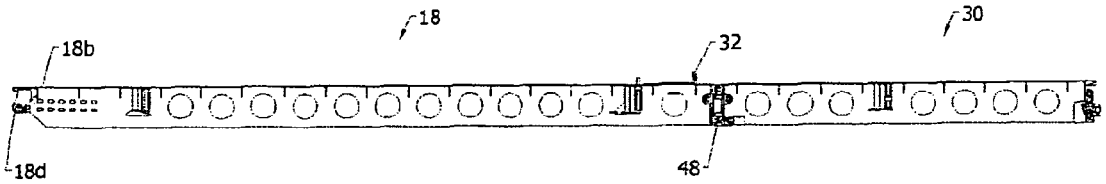
FIG. 10*a* is, in side elevation view, the tubular transport arm and trolley.
Figure 10B:
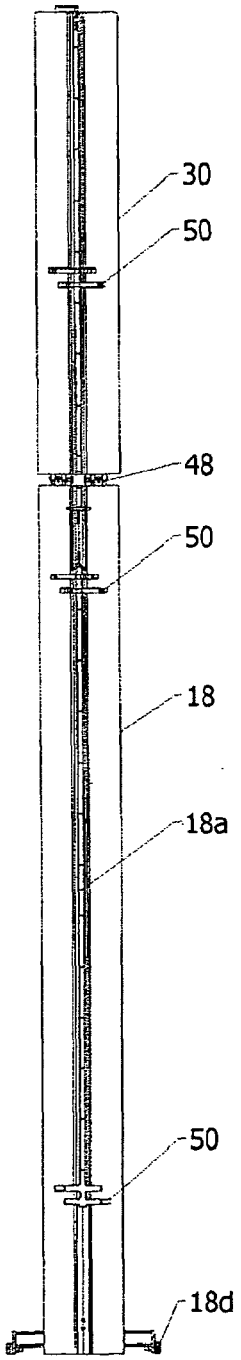
FIG. 10*b* is, in plan view, the tubular transport arm and trolley of FIG. 10.
Figure 10C:
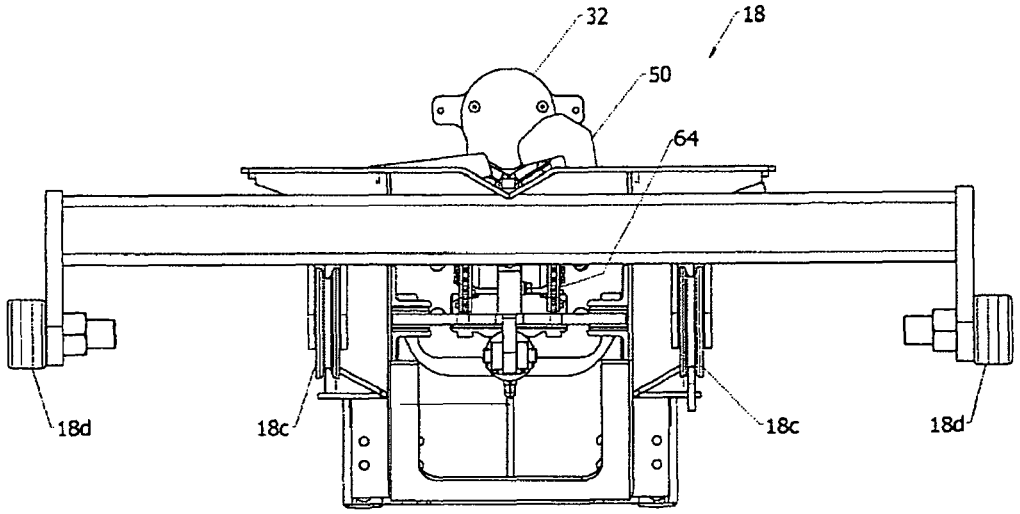
FIG. 10*c* is, in end elevation view, the inboard end of the tubular transport arm of FIG. 10.
Figure 10D:
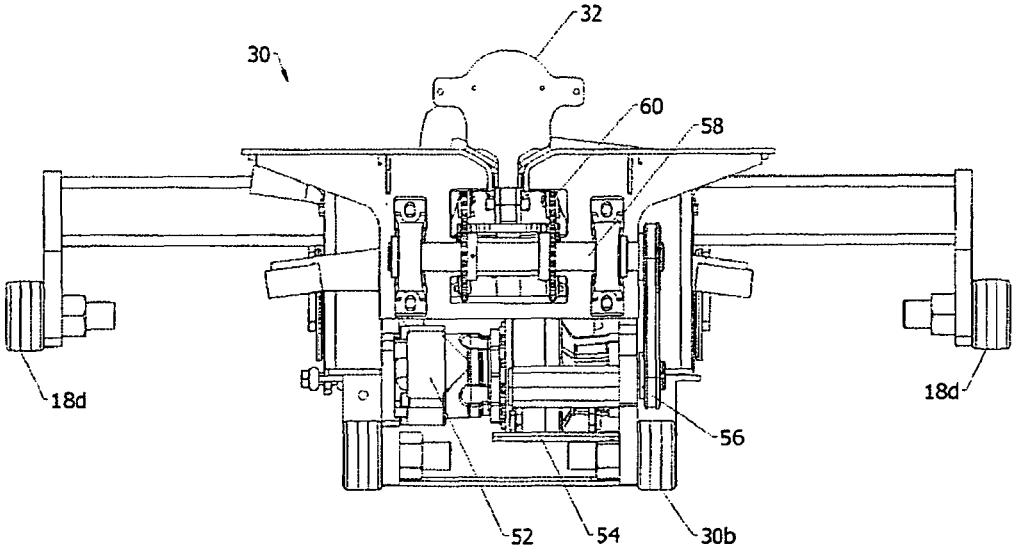
FIG. 10*d* is, in end elevation view, the outboard end of the tubular transport trolley of FIG. 10.

As seen in the accompanying figures wherein like reference numerals denote corresponding parts in each view, as depicted in FIG. 1, the portable pipe handling system according to one aspect of the present invention includes a catwalk 10 positioned at ground level and having a pipe handler mast 12 mounted to, so as to extend upwardly from, the inboard end of catwalk 10.

As used herein, catwalk may also be referred to as included within the meaning of the word "base". Use of the word base herein is intended to refer to a structure upon or to which the pipe handler mast is coupled. Base may but does not necessarily include a catwalk, storage facilities for tubulars, whether horizontally stored or not, and facilities for providing tubulars to and from storage, and to and from the pipe handler mast. Further, use of the phrase pipe handler mast may also be referred to as included within the meaning of the phrase "pipe handler support structure" or "support structure". Those phrases are intended to refer to a structure which is coupled to the base and which supports a pipe stand building axis as hereinafter described and associated apparatus to make-up or to break-down, or both, a pipe stand of tubulars when the pipe stand is positioned, held, guided, and/or conveyed along the pipe stand building axis. The pipe handler mast is merely intended to be one example of structures which would work for this intended purpose as would be known to one skilled in the art. For example an alternative support structure may include a vertical mast, that is, not on the pipe stand building axis, and outstanding arm arrangement for supporting a pipe stand along the inclined pipe stand building axis. The support structure would support working elements such as apparatus for relative counter-rotation of the threads in a pipe stand joint so as to spin, make-up or break-down a pipe stand, or assist in doing so, which may include, without limitation, wrenches or tongs, or spinners, as would be known to one skilled in the art, and which, without intending to be limiting, are collectively referred to herein as pipe stand joint thread rotators. At least one pipe stand or tubular handler would also be supported on the support structure, which, without intending to be limiting, is intended to include not only the tubular transport arm and robotic arm described below, but also other apparatus for lifting, winching, hoisting, guiding, or otherwise positioning by mechanical or electromechanical or other assisted means the positioning of pipe stands and tubulars, as would be known to one skilled in the art. The handler or handlers would be assisted by pipe stand holders which guide, hold in place on, and may advantageously also selectively elevate or convey the pipe stand or tubulars along the pipe stand building axis. Examples of such pipe stand holders, as the term is intended to be broadly interpreted, include the various elevators and/or rollers, slips and clamps, skates and the like described below which guide, hold and convey tubulars and the pipe stand.

Returning now to the example of the illustrated embodiments, pipe handler mast 12 is positioned adjacent a drilling rig mast 14 and corresponding substructure 16. A tubular transport arm 18 delivers tubulars 20 from catwalk 10 to pipe handler mast 12. A wrench 22 and pipe stand elevators 24, for making up multiple tubular pipe stands within pipe stand handler mast 12, are mounted to mast 12. Mast 12 is positioned and aligned for delivery of the top of the pipe stand 8 to top drive 26 mounted in drilling rig mast 14, and in particular for delivery of the pipe stand to top drive elevators 26*a*.

Tubulars 20 are delivered in a conventional fashion onto catwalk 10 from conventional pipe racks 28 so as to rest a tubular from the rack into a longitudinally extending centre channel 10*a* of the catwalk.

Figure 24A:
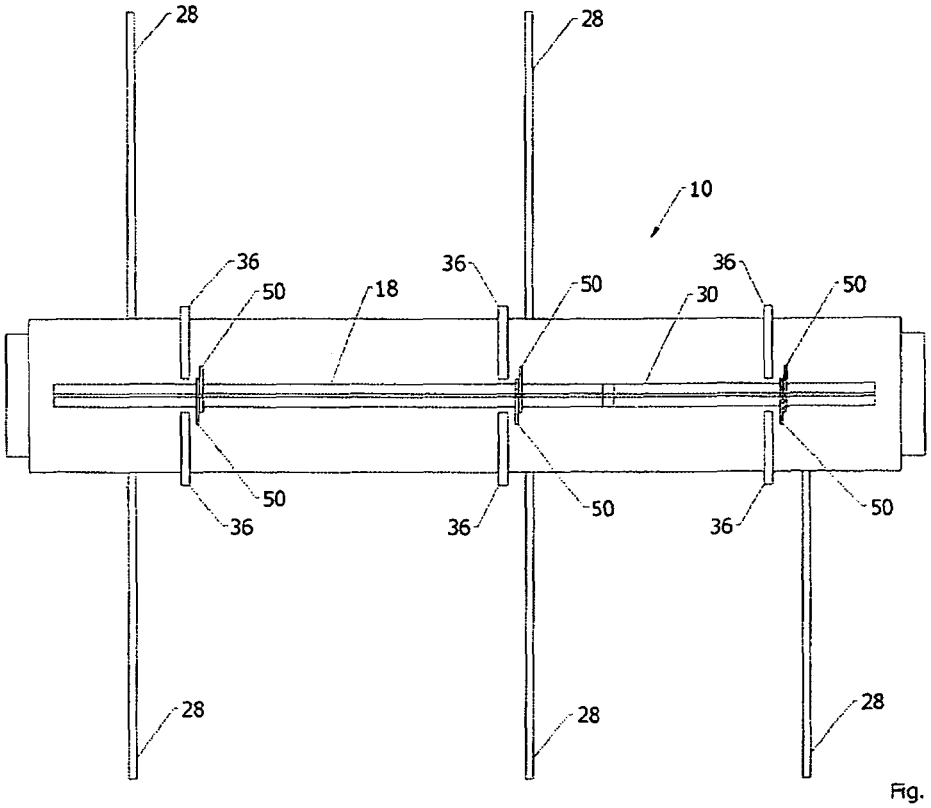
FIG. 24*a* is, in plan view, a catwalk and pipe racks according to one embodiment.
Figure 24B:
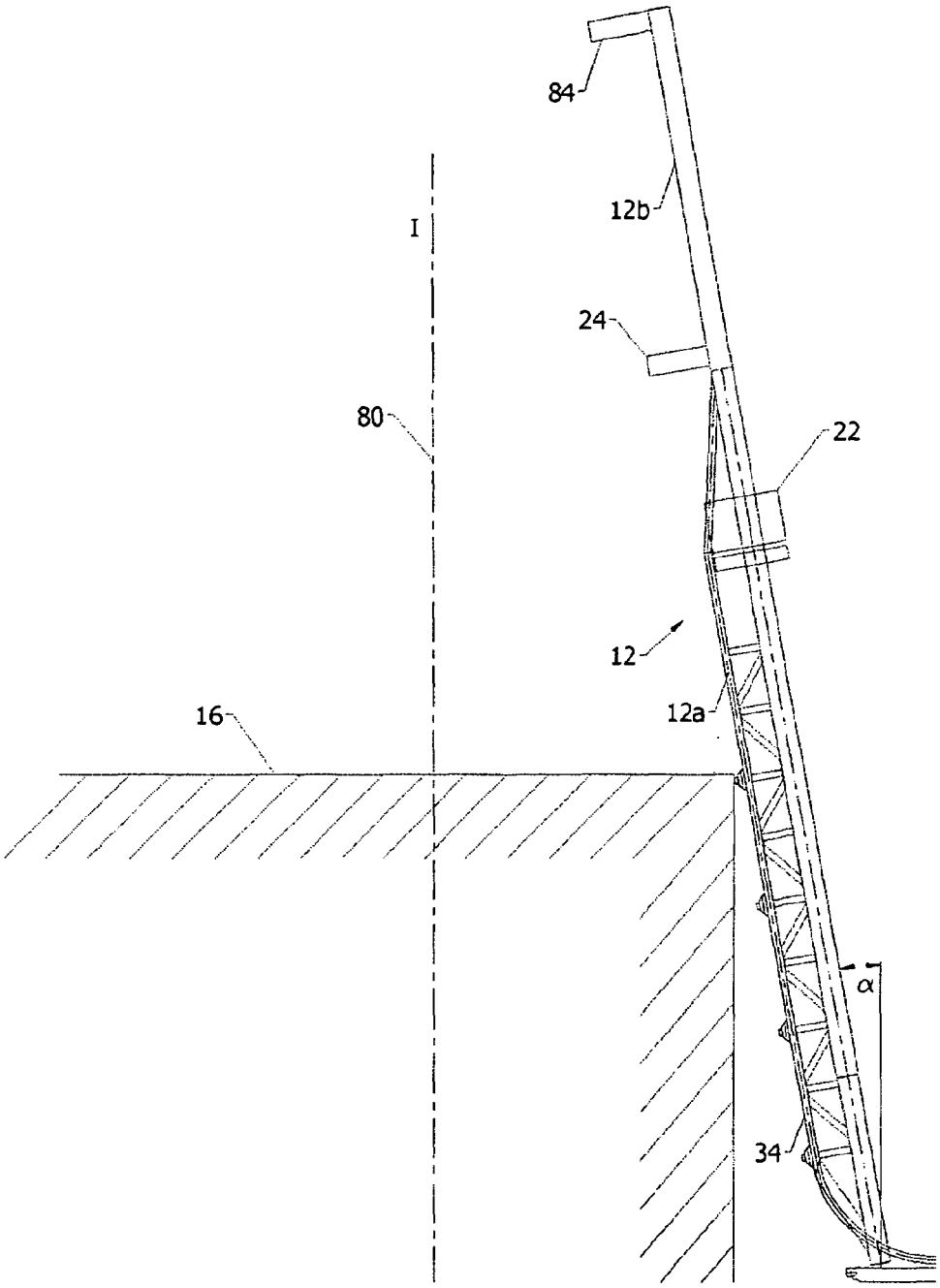
FIG. 24*b* is, in side elevation, a stand building mast mounted to the catwalk of FIG. 24*a*.

Tubular transport trolley 30 is mounted within centre channel 10*a* of catwalk 10 for translation longitudinally along the catwalk. Tubular transport arm 18 (also labelled in FIGS. 24*a*, 24*b* as "TTA") is pivotally mounted at the outboard end thereof to a corresponding inboard end of tubular transport trolley 30. A skate 32 is mounted for travel along the entire length of abutting slots 18*a* and 30*a* in tubular transport arm 18 and tubular transport trolley 30 respectively. Skate 32 runs some or all of the length of slots 18*a* and 30*a* on an endless chain.

Although the sequence is also better described below with reference to FIGS. 13-23, in summary, tubulars 20 are fed one at a time onto trolley 30 and conveyed by skate 32 onto arm 18. Arm 18 and trolley 30, which are mounted together by a hinge, are translated towards mast 12. The inboard end 18*b* of arm 18 is elevated upwardly by actuators better described below along guides such as tracks 34 so as to deliver tubular 20 into mast 12. Trolley 30 remains horizontal unless the hinge is pinned making the trolley co-linear with arm 18 so that a casing, which is longer (for example 45 feet long) than a tubular may be delivered from the catwalk to mast 12. Where tubulars are being delivered, and thus trolley 30 is left free to rotate on its hinge relative to arm 18, trolley 30 is drawn to the bottom of mast 12 as arm 18 pivots into the confines of mast 12. Skate 32 pushes the tubular up arm 18. Elevators 24 engage tool joint 20*a* of tubular 20 and draws the tubular upwardly along mast 12 while arm 18 retracts downwardly so as to reposition arm 18 within channel 10*a*, whereupon arm 18 and trolley 30 receive another tubular 20 from the pipe rack 28 or to receive a casing if a double casing is being made up in mast 12 instead of a pipe stand such as a triple pipe stand. The cycle is then repeated so as to bring the second tubular (or second casing) up into mast 12. The lowermost end 20*b* of tubular 20, that is, the lowermost end of the first tubular, is positioned in wrench 22 so as to be mated with the uppermost end of the second tubular being delivered by arm 18 into the lower portion of mast 12 below wrench 22. The wrench 22 includes a wrench and spinner and operates on the first and second tubulars in a conventional fashion so as to thread the tool joints of the adjacent ends of the tubulars one into the other. Skate 32 and elevators 24 then continue to elevate the now twin-tubular pipe stand 8 upwardly along mast 12. This may result in the uppermost end of the pipe stand protruding from the upper end of mast 12 as the lowermost end of the twin-tubular pipe stand is positioned into wrench 22 awaiting mating to the upper end of a third tubular being delivered by the next cycle of the operation of arm 18.

Once the triple-tubular pipe stand has been made up, the pipe stand elevators extend the pipe stand upwardly in direction A along trajectory B so as to position the uppermost end of the pipe stand 8, that is, so as to position end 20*a* of the first tubular 20 within the pick up range of the articulated elevators 26*a* on top drive 26. Thus in the example illustrated in FIG. 1, articulation of top drive elevators 26*a* in direction C engages the top drive elevators with the top end of the pipe stand extending upwardly from mast 12 along trajectory B. It will be appreciated that, because the top drive translates vertically and carries the elevators with it, the pickup range of the articulated elevators 26*a*, which may for example extend approximately five feet radially outwardly of the top drive 26, will define a window interface area between the uppermost end 20*a* of pipe stand 8 and the pipe stand engaging end of elevators 26*a*. The size of the window interface area, also referred to herein as hand-off window 100, is thus governed by the distance the elevators extend outwardly of the top drive, and the vertical distance traveled by the top drive, keeping in mind that pipe stand 8 must be built up of tubulars (three tubulars in the present example, which is not intended to be limiting) without projecting the upper end of the pipe stand through well center, as that would interfere with drilling operations, which therefore defines the maximum angle that the pipe stand can be inclined towards the drilling mast (and thus the lower effective end of hand-off window 100), and so that the upper end of the pipe stand still intersects at least the upper end of the hand-off window 100 (governed by the upper limit of the top drive vertical travel), which therefore defines the minimum angle that the pipe stand must be inclined towards the drilling mast in order to accomplish the hand-off of the pipe stand to the elevators. The angle of inclination of the pipe stand towards the drilling mast as measured from the vertical is referred to herein as angle alpha, discussed further below. The description of hand-off window 100 is not intended to be limiting as it may be that the top drive itself may be moved away from well center in which case the hand-off window would move dynamically with the location of the top drive away from well center. For example the top drive may be moved away from well center by a top drive retractor which may as described herein be employed to make tripping in and out more efficient in combination with the presently described pipe handling system or in combination with for example a robotic pipe handler mounted on mast 12 or mounted on another support structure which provides the portability according to one aspect of the present invention. The inclination angle also provides the benefit of controlling the degree of freedom of the pipe stand while on the stand building axis, and also as the pipe stand is being conveyed along trajectory B in that the weight of the pipe stand settles and stabilizes the pipe stand in the pipe stand holders as that term is defined herein. This improves the ease with which the pipe stand is controlled, keeping in mind that a triple pipe stand will typically have a length in the order of ninety feet making it somewhat difficult to control.

In one embodiment, and, again, dependent on the location and size of the effective hand-off window, the inclination angle $\acute{\alpha}$, (alpha), that is, the pipe stand inclination angle alpha measured from the vertical, may, without intending to be limiting, advantageously be in the order of 5 to 25 degrees. The range of angle $\acute{\alpha}$, (alpha) angles which would work for handing off a pipe stand in the hand-off window would for example depend on whether space was required between the rig substructure 16 and the pipe stand building mast 12 for the positioning of the blowout preventers, in which case angle $\acute{\alpha}$, (alpha) may be greater to provide for greater spacing. In instances where mast 12 may be substantially abutted against, or inset into, substructure 16, then angle $\acute{\alpha}$, (alpha) may be less so long as trajectory B guides pipe stand 8 in direction A along trajectory B so as to intersect the upper end of the pipe stand with hand-off window 100 for top drive elevators 26*a*.

The catwalk 10 and associated equipment will now be discussed in more detail. Preferably pipe racks 28 are positioned on opposite sides of catwalk 10. Pipe racks 28 are inclined so that tubulars 20 stored on top of pipe racks will roll downwardly towards catwalk 10 whereupon they may be indexed from behind stops 28*a* onto trolley 30 by the upwardly actuated inclination of lateral transfers 36 which elevate a tubular 20, one at a time, over stops 28*a* so that the singulated tubular rolls down lateral transfer 36 and onto trolley 30 which has been positioned adjacent the inboard or centremost ends of lateral transfers 36. This is done while making up pipe stands. When the opposite is being done; namely, pipe stands are being broken down and their tubulars are being returned to the pipe racks, then arm 18 and trolley 30 are used to return tubulars to the horizontal, adjacent the pipe racks. Kickers 50 are actuated so as to extend upwardly from under the upper surfaces of arm 18 and trolley 30. Kickers 50 engage upwardly through, so as to move laterally across, slots 18*a* or 30*a* depending on whether they mounted on arm 18 or trolley 30 respectively. When actuated, kickers 50 will disgorge a tubular from resting on either or both of arm 18 or trolley 30 so as to roll the tubular off the catwalk, over lateral transfers 36 and onto pipe racks 28.

Catwalk 10 includes longitudinally extending bracing 38 mounted on opposite sides of channel 10*a* and extending the longitudinal length over main skid 40. A hydraulic power unit 42 may be mounted in the outboard end, the end distal from mast 12. Pivot supports 44 are mounted at the opposite inboard end of catwalk 10 for pivotally supporting mast 12 thereon.

Tubular transport arm 18 and tubular transport trolley 30 run along lower tracks 46 within channel 10*a* on rollers 18*c* and 30*b* respectively. Rollers 18*d* on the inboard end of arm 18 run in tracks 34 as the inboard end 18*b* of arm 18 is hoisted upwardly along the base section of 12*a* of pipe handler mast 12. As arm 18*a* is hoisted upwardly along mast 12, arm 18 pivots on hinges 48 relative to trolley 30 which remains horizontal within channel 10*a* in catwalk 10 unless the hinge has been pinned or otherwise disabled so that arm 18 and trolley 30 move together. As described elsewhere herein, hinges 48 are disabled when it is desired to deliver an object which is longer than a tubular, such as a length of casing, for example for making up a double length casing for delivery to well center. Thus trolley 30 translates in direction D towards mast 12 as arm 18 is hoisted so as to deliver a tubular 20 into the base section of 12*a* of mast 12. Base section 12*a* is advantageously primarily only supported along its sides and is substantially open front and back for delivery of tubulars into and out of base section 12*a*.

A skate drive motor 52 is mounted at the outboard end, that is, the end opposite to hinges 48, in trolley 30. Skate drive motor 52 drives a gear box 54 containing a planetary drive, gear box 54 driving a skate drive shaft 58 via drive chain 56. The endless skate drive chains 62, which carry skates 32 thereon, are driven by sprockets 60 mounted on drive shaft 58. Endless skate drive chains 62 are driven by sprocket 60 at the outboard end of trolley 30, and pass around inboard idler sprockets 64 at the inboard end of arm 18, skate drive chain 62 passing through hinges 48 so as to be operative while arm 18 is either horizontal or in an inclined position for example nested flush within base section 12*a* of mast 12.

Figure 11:
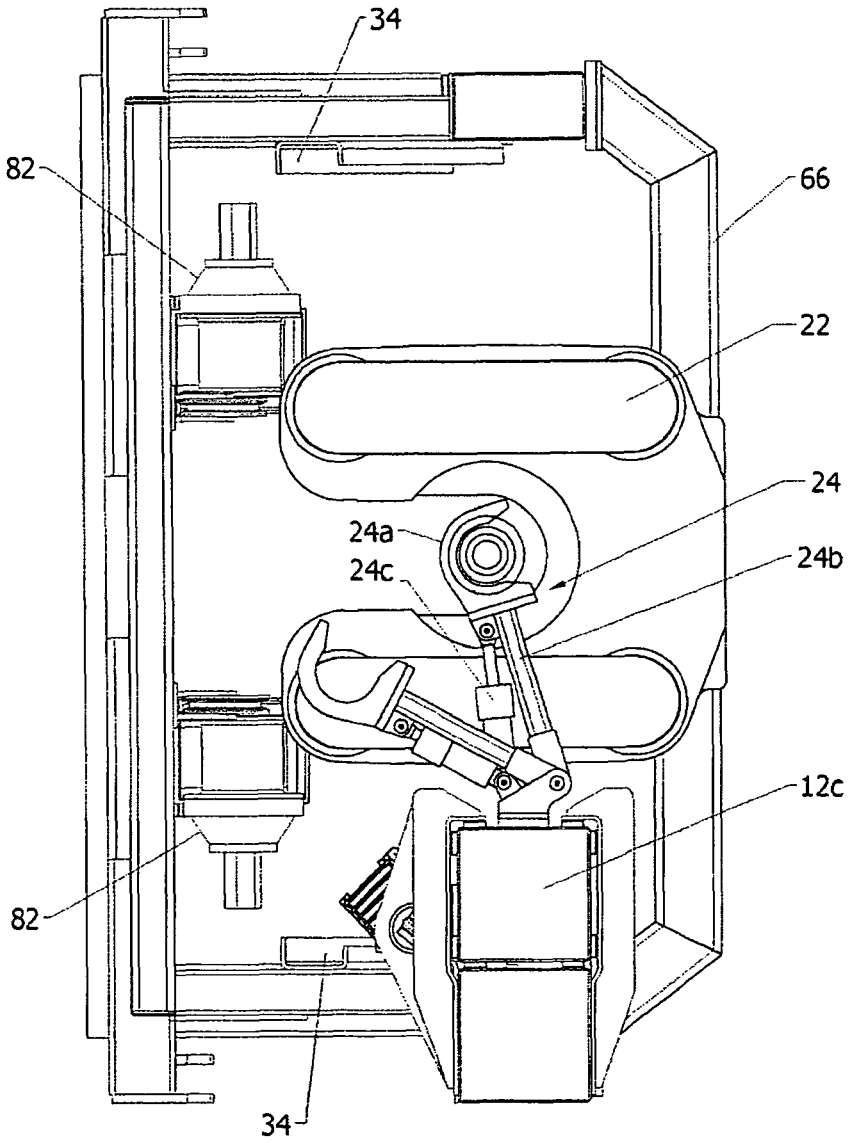
FIG. 11 is, in plan view, the pipe stand wrench and spinner mechanism mounted to the pipe handling system mast and also showing the pipe stand elevators and winches for raising the tubular transport arm according to a further embodiment of the pipe handling system.

The balance of the pipe handler mast will now be explained. Upper section 12*b* of pipe handler mast 12 is mounted onto the upper end of base section 12*a*. In the embodiment of FIGS. 1-7, upper section 12*b* is a truss structure for example forming substantially a "T"-shape in substantially horizontal cross section. The outboard side of the T-shaped cross section is a planar truss coplanar with the outboard legs 12*a*' of base section 12*a*. An inboard truss is mounted orthogonally to the inboard side of the outboard truss of upper section 12*b*. Thus the outboard side truss work may be supported between outboard supports 12*b*' which are collinear with supports 12*a*'. The inboard truss-work may be supported on inboard support 12*b*". Wrench 22 may be mounted for example at approximately the mid section of mast 12, for example, approximately at the intersection between the upper and lower sections 12*b* and 12*a* respectively of mast 12. Wrench 22, better seen in FIG. 11, may be of conventional design having an upper rotating spinner section and a lower back up jaw so as to either make up tool joints or break tool joints. Wrench 22 may be mounted onto a supporting framework 66 mounted to, so as to extend between, supports 12*a*' over supports 12*b*' depending on for example the expected lengths of the tubulars which will dictate the position of the tool joints for operation of the wrench 22.

The inboard truss work of upper section 12*b* may be offset laterally relative to supports 12*b*' so as to not interfere with pipe stand 8 being extended in direction A from tubular transport arm 18 and through wrench 22 by pipe stand elevators 24.

In a preferred embodiment, a platform 68 is rigidly mounted to the uppermost end of upper section 12*b* of mast 12, for example by means of bracing 68*a*. An articulated robotic arm 70 may be mounted on top of platform 68 so as to be adjacent pipe stand 8 extending along trajectory B from mast 12. Robotic arm 70 includes a pipe stand gripper 72 mounted at the distal end of one or more articulated arm segments 74 atop, for example, a rotating base section 76. Robotic arm 70 is adapted to be selectively rotated about a vertical axis of rotation E, hereinafter referred to as slewing. Slewing as used herein means rotation of robotic arm 70 in direction F about axis of rotation E. Advantageously, gripper 72 contains a plurality of pipe gripping mechanisms, which may be linearly spaced apart along the length of the pipe to be gripped, and wherein gripper 72 is pivotally mounted to the distal end of the adjacent articulated arm segment 74 for rotation of gripper 72 about lateral axis rotation G in direction H.

An anti-sway structure such as U-shaped frame member 78 is provided for stabilizing, laterally, mast 12 to the drilling rig mast 14 without substantially vertically reacting loading on mast 12 to mast 14. Mast 12 may for example be stabilized to the front legs 14*a* of the drilling rig mast 14, although other ways of stabilizing mast 12 to mast 14 or rig substructure 16 would also work. U-shaped frame member 78 may be for example pinned at ends 78*a* to legs 14*a* so that the base end 78*b* may be pinned to the uppermost end of upper section 12*b* of mast 12 to provide further support to the upper end of pipe handler mast 12. Frame member 78 may be quickly attached and to, detached from, front legs 14*a* of mast 14 so as to not interfere with the portability of the catwalk and pipe handler mast system.

The use of robotic arm 70 provides for the primary purpose of tripping pipe stands into and out of the well. Thus robotic arm 70 effectively transfers pipe or pipe stands or lengths of casing between the top drive elevators at or near well center and the racking board for tripping. Robotic arm 70 also provides a secondary purpose; namely, delivering the upper end of pipe stand 8 from the stand-building axis of trajectory B to the hand-off window for top drive elevators 26*a*. In particular, once pipe stand 8 has been extended by the pipe stand elevators 24 from the upper end of mast 12, grippers 72 are engaged with the adjacent tubular walls of the pipe stand and the pipe stand then elevated as necessary to clear the bottom end of the pipe stand from interfering with the upper floor of substructure 16, and once so elevated, pipe stand 8 may be rotated to the vertical and translated along one side or the other of platform 68 to thereafter either rack the pipe stand 8 into the racking board 14*b* mounted to legs 14*a* (so as to rack the pipe stand for storage between the racking board fingers), or so as to present the pipe stand to well centre 80, for example, so as to be substantially parallel to and collinear with or adjacent to well centre axis I whereupon the upper end of the pipe stand may be engaged by the top drive elevators 26*a*. This then provides a second mechanism for handing off to the top drive within mast 14 a pipe stand 8 which has been made up within mast 12.

Figure 12:
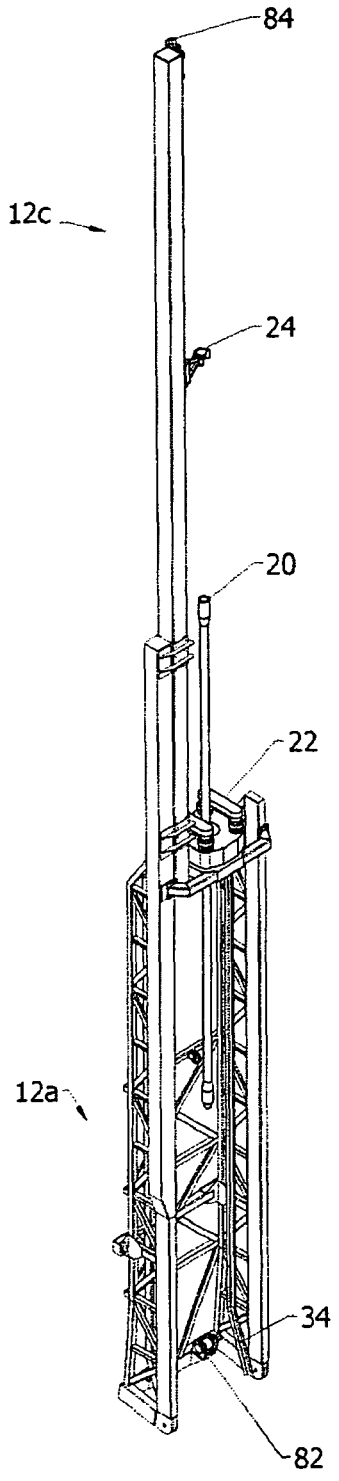
FIG. 12 is, in perspective view, the pipe handling system mast according to the embodiment of FIG. 11.
Figure 12A:
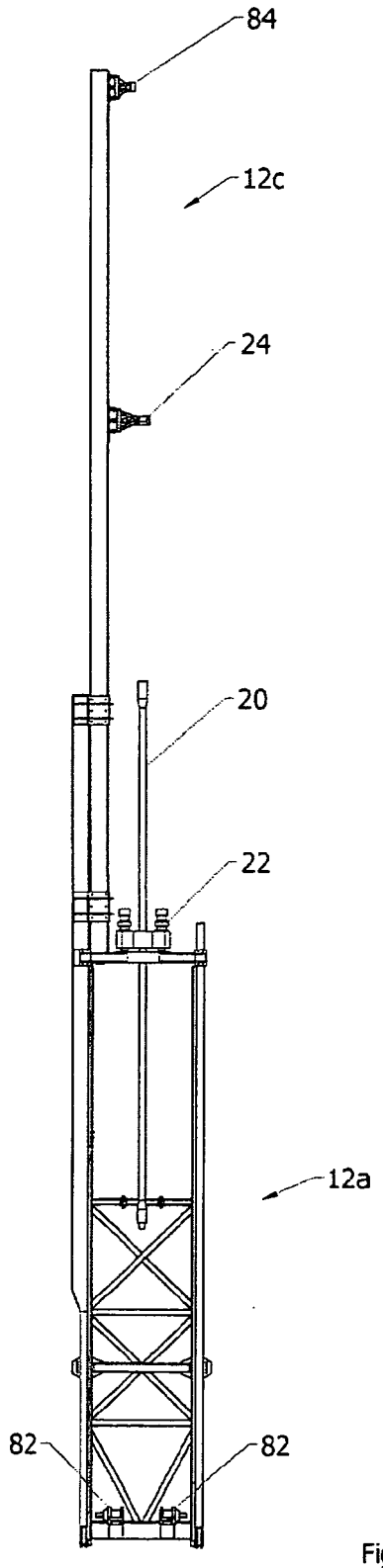
FIG. 12*a* is, in elevation view, the pipe handling system mast of FIG. 12.

In the alternative embodiment depicted commencing in FIG. 12, upper section 12*b* of pipe handler mast 12 is a linear beam 12*c* mounted on top of base section 12*a* so as to extend longitudinally upwardly therefrom. Beam 12*c* is offset from the path of tubulars 20 being translated upwardly through wrench 22 during the operation of the pipe stand elevators 24, wrench 22, and tubular transport arm 18 to form pipe stands 8.

As before, the inboard end 18*b* of tubular transport arm 18 is elevated up along base section 12*a* as rollers 18*d* travel in tracks 34 running the length of base section 12*a* inset laterally from the outer trusses. A winch 82 which may be mounted for example at the lower end of base section 12*a*, or other actuators as would be known to one skilled in the art, are used to selectively elevate inboard end 18*b* to thereby draw arm 18 up from its horizontal position when laid within catwalk 10 to its fully inclined position within base section 12*a* to thereby carry a tubular 20 from the catwalk to its pipe stand building position under wrench 22. As with upper section 12*b*, elevators 24 are selectively translated along the length of beam 12*c* and may employ collars 24*a* mounted on the ends of arms 24*b*, where the arms 24*b* are rotatable relative to either beam 12*c* or upper section 12*b* by the use of for example actuators 24*c* to thereby position collars 24*a* under the pipe stand tool joints. Collars 24*a* fit snugly under the tool joint and around the adjacent tubular so that the pipe stand may be elevated in direction A relative to mast 12. A tubular support 84 may be mounted at the upper most end of beam 12*c* to hold a pipe stand 8 in position once elevated by elevator 24 while elevator 24 is retracted from contact with pipe stand and lowered to engage a tool joint lower on the pipe stand. Tubular support 84 may, similar to elevator 24 employ an open collar which engages under tool joint snugly around the tubular.

Figure 13:
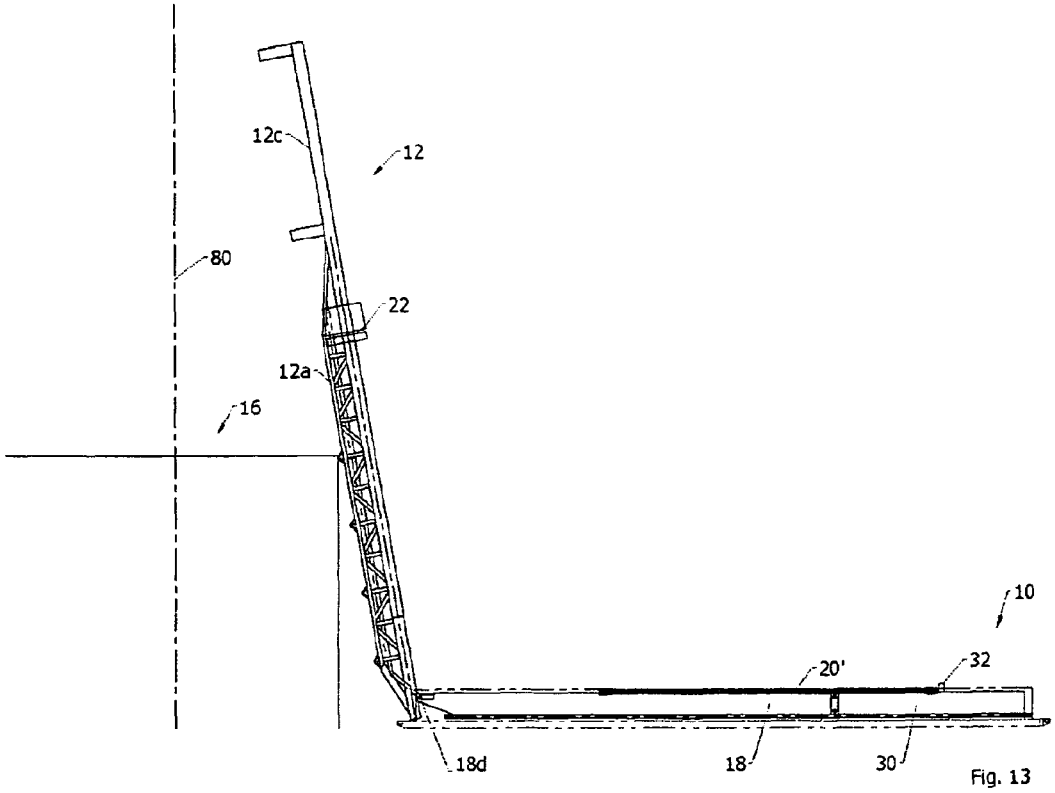
FIG. 13 is, in side elevation view, the pipe handling system mast of the embodiment of FIG. 12, mounted to a catwalk and positioned adjacent a drilling rig substructure, and showing a first tubular loaded onto the catwalk.
Figure 14:
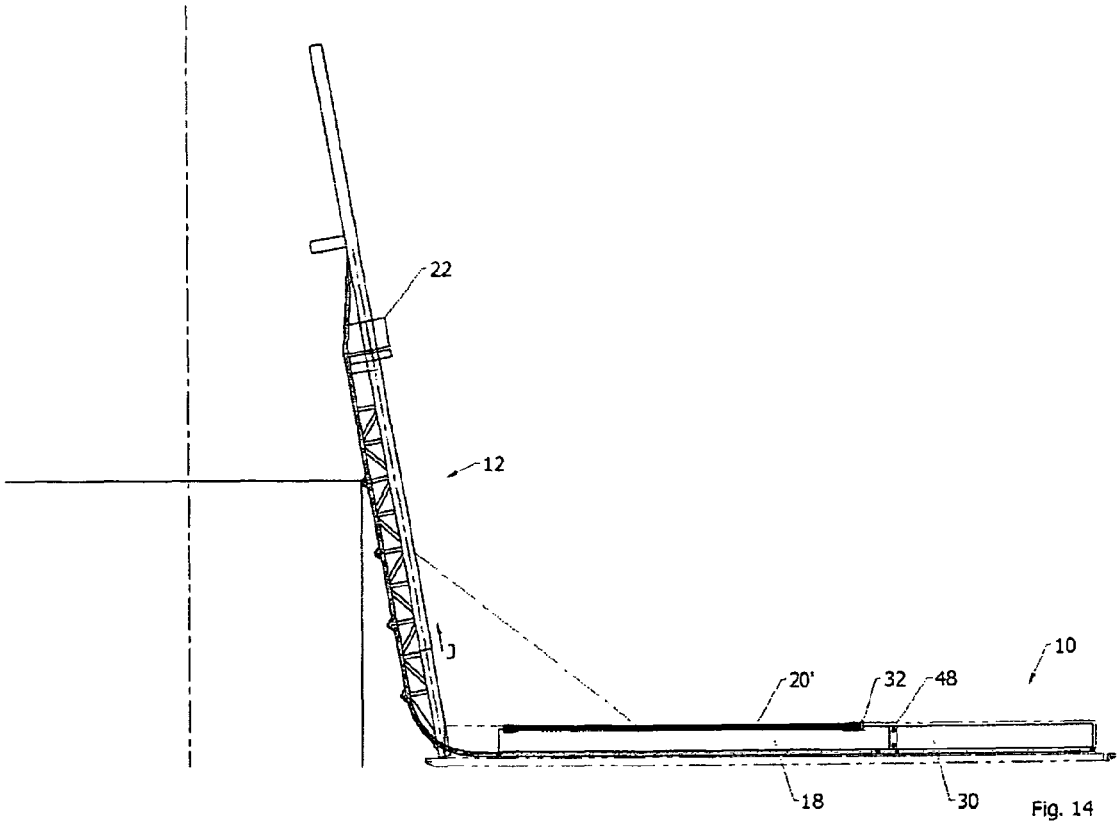
FIG. 14 is the view of FIG. 13 wherein the first tubular has been translated to an inboard position on the catwalk.
Figure 15:
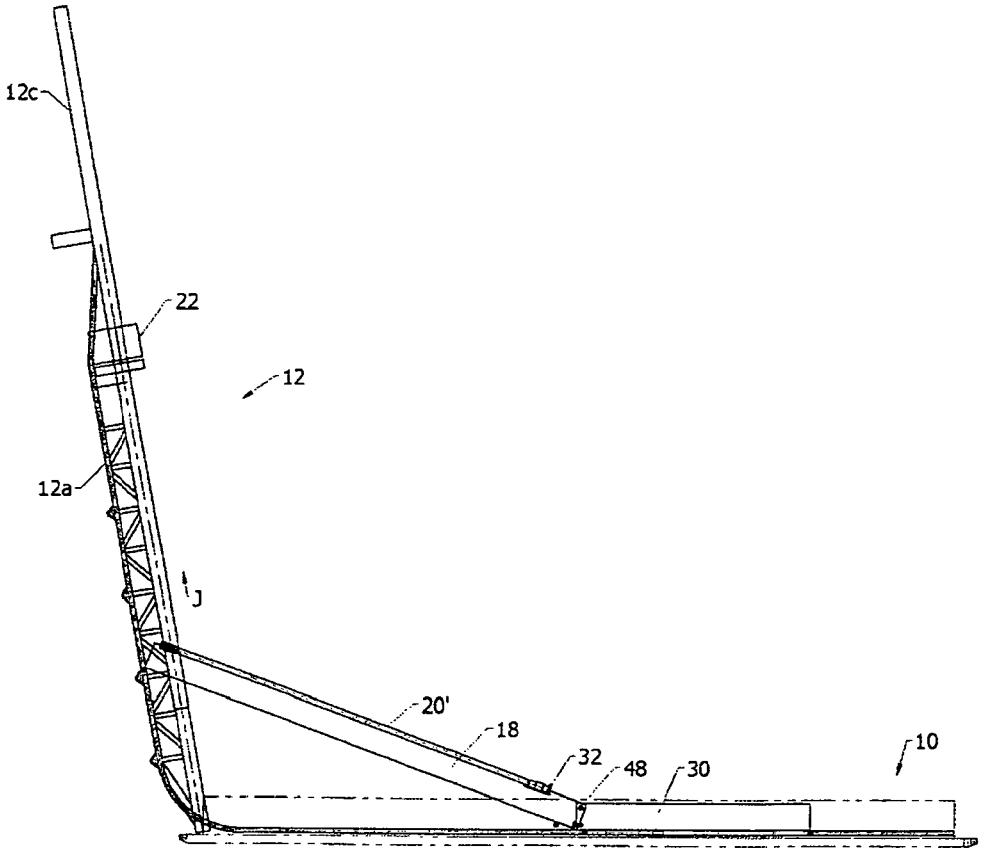
FIG. 15 is the view of FIG. 14 wherein the tubular transport arm is being elevated through an intermediary elevated position between the horizontal and the fully inclined.
Figure 16:
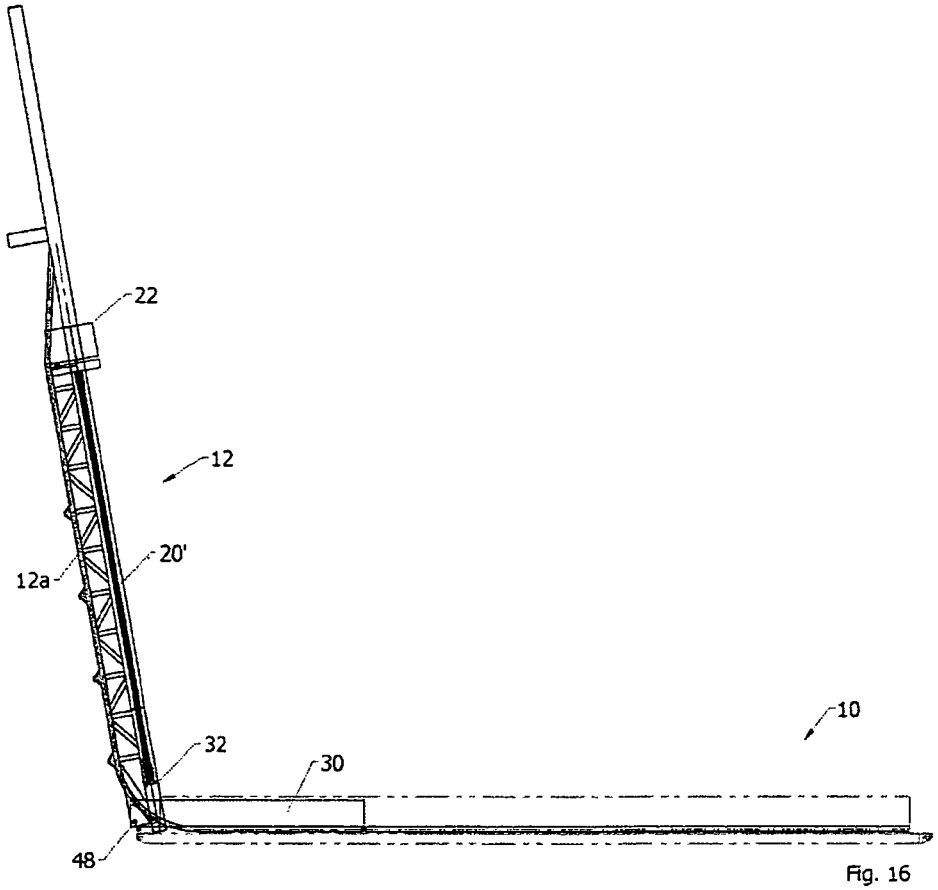
FIG. 16 is the view of FIG. 15 with the tubular transport arm in the fully inclined position within the base section of the pipe handling system mast and with the tubular transport arm fully pivoted relative to the tubular transport trolley which remains horizontal in the catwalk.

What follows now, with reference to FIGS. 13-22, is a description of the make up of a triple pipe stand by following, sequentially, the movement of first, second and third tubulars 20', 20", 20''' respectively, as they move from the pipe rack to a position extending upwardly from the top of mast 12 ready for hand off to the top drive elevators 26*a*. Thus as seen in FIG. 13, first tubular 20' is deposited from pipe rack 28 onto catwalk 10 so as to rest on the top surface of tubular transport arm 18 and tubular transport trolley 30 respectively. Skate 32 which has been positioned towards the outboard end of trolley 30, engages against the outboard end of tubular 20' and pushes tubular 20' so that it rests completely on tubular transport arm 18 as seen in FIG. 14. Rollers 18*d* at the inboard end of arm 18, are positioned in roller tracks 34. The inboard end 18*b* of arm 18 is connected to an actuator such as a winch cable which passes over sheaves, for example mounted adjacent wrench 22 for winding of the cable onto and off from a winch or winches 82 mounted to base section 12*a*. Actuation of winches 82 elevates inboard end of 18*b* and thus elevates the entire length of arm 18 upwardly in direction J through a diagonal position illustrated in dotted outline in FIG. 14 and shown in FIG. 15, that is, rotates arm 18 through the intermediate position of FIG. 15 while arm 18 pivots about hinges 48 relative to trolley 30. With arm 18 fully elevated so as to reside within and between the trusses on either side of base section 12*a*, skate 32 is actuated so as to drive tubular 20' in direction J relative to arm 18 which now remains stationary within base section 12*a*, trolley 30 having been drawn on its rollers along the length of channel 10*a* of catwalk 10 as seen in FIG. 16.

Figure 17:
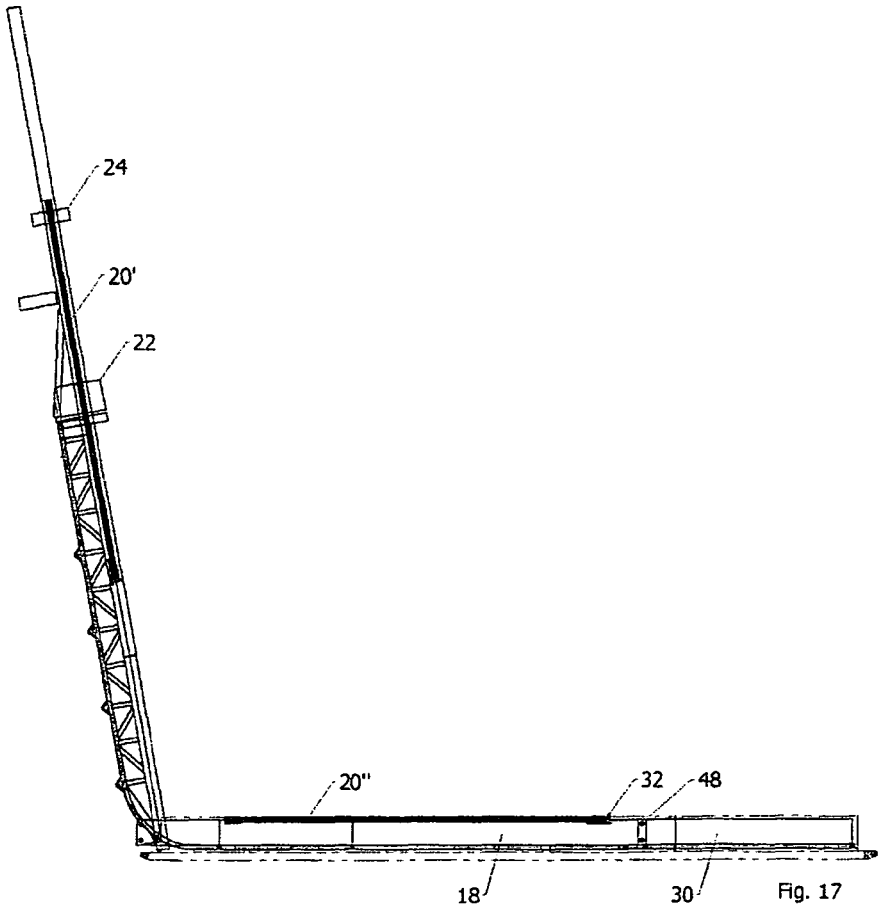
FIG. 17 is the view of FIG. 16 with the first tubular being elevated, having been elevated by a skate on the tubular transport arm and being handed off to a pipe stand elevator on the pipe handling system mast, and wherein the tubular transport arm has been returned to the horizontal and a second tubular loaded onto the catwalk and advanced onto the inboard end of the tubular transport arm.
Figure 18:
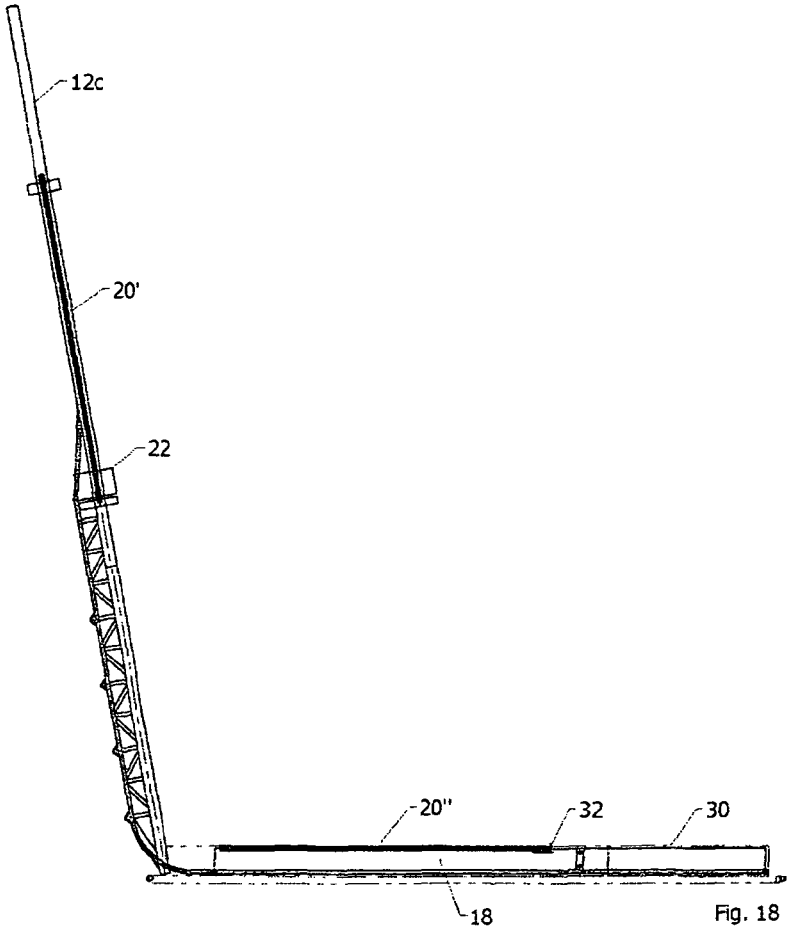
FIG. 18 is the view of FIG. 17 with the first tubular raised so as to position its lowermost end into the wrench for mating to the second tubular.
Figure 19:
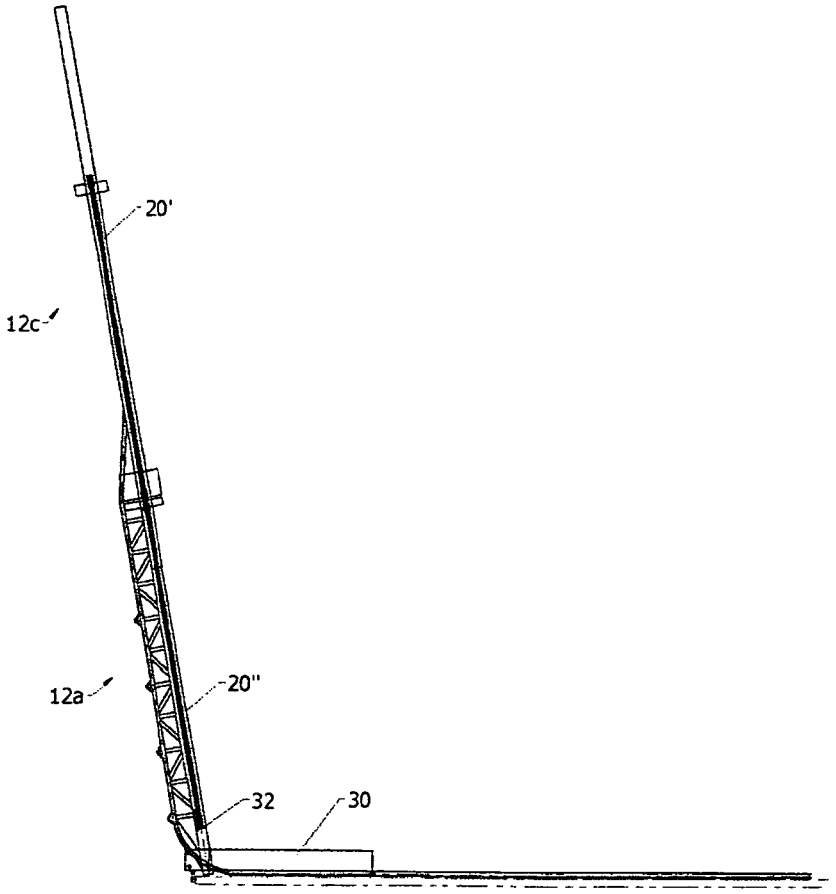
FIG. 19 is the view of FIG. 18 wherein the tubular transport arm has once again been elevated to the fully inclined position within the base section of the pipe handling system mast and wherein the skate in the tubular transport arm has elevated the second tubular into engagement with the first tubular within the wrench.
Figure 20:
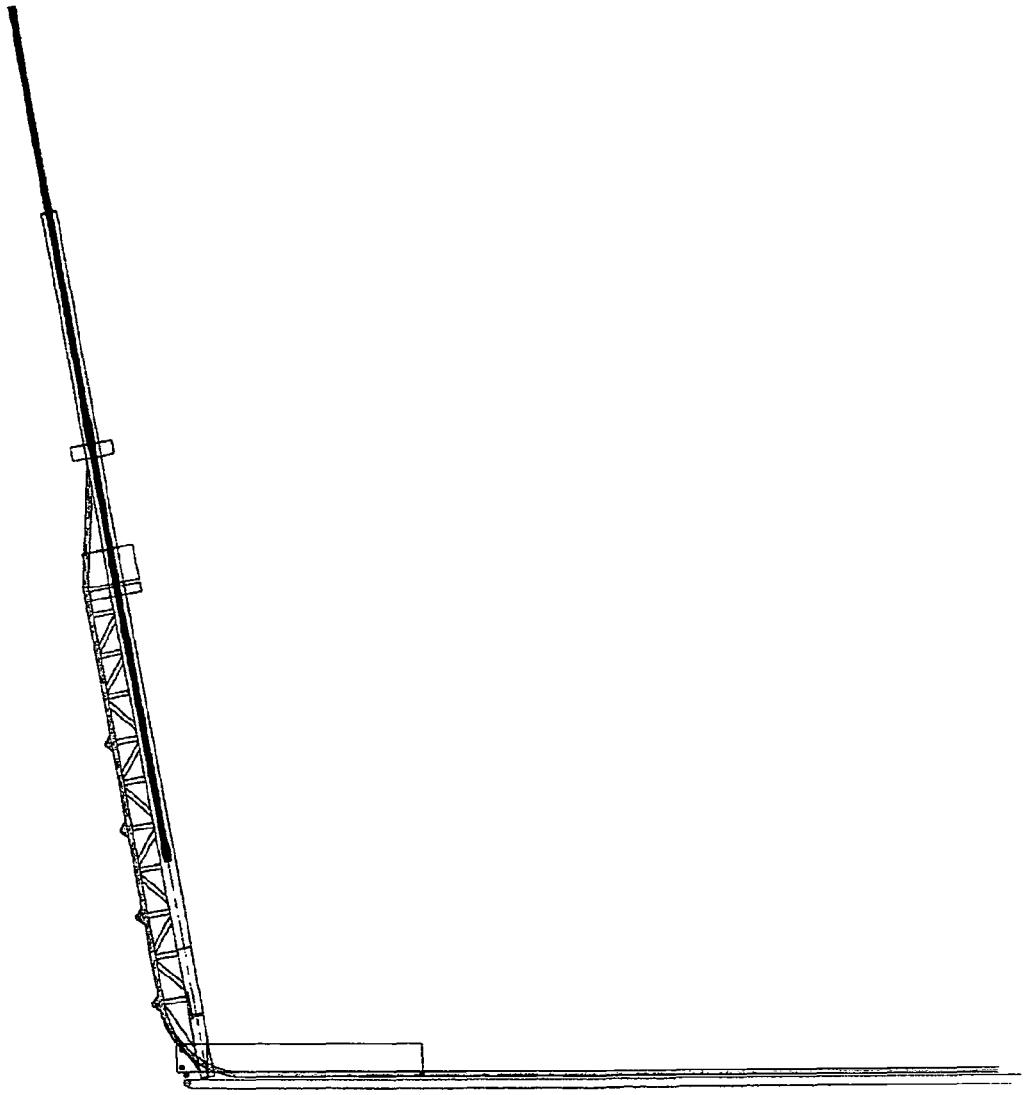
FIG. 20 is the view of FIG. 19 wherein the first and second tubulars have been made up into a double pipe stand and the pipe stand elevator has engaged the middle tool joint of the pipe stand for elevation of the pipe stand.
Figure 21:
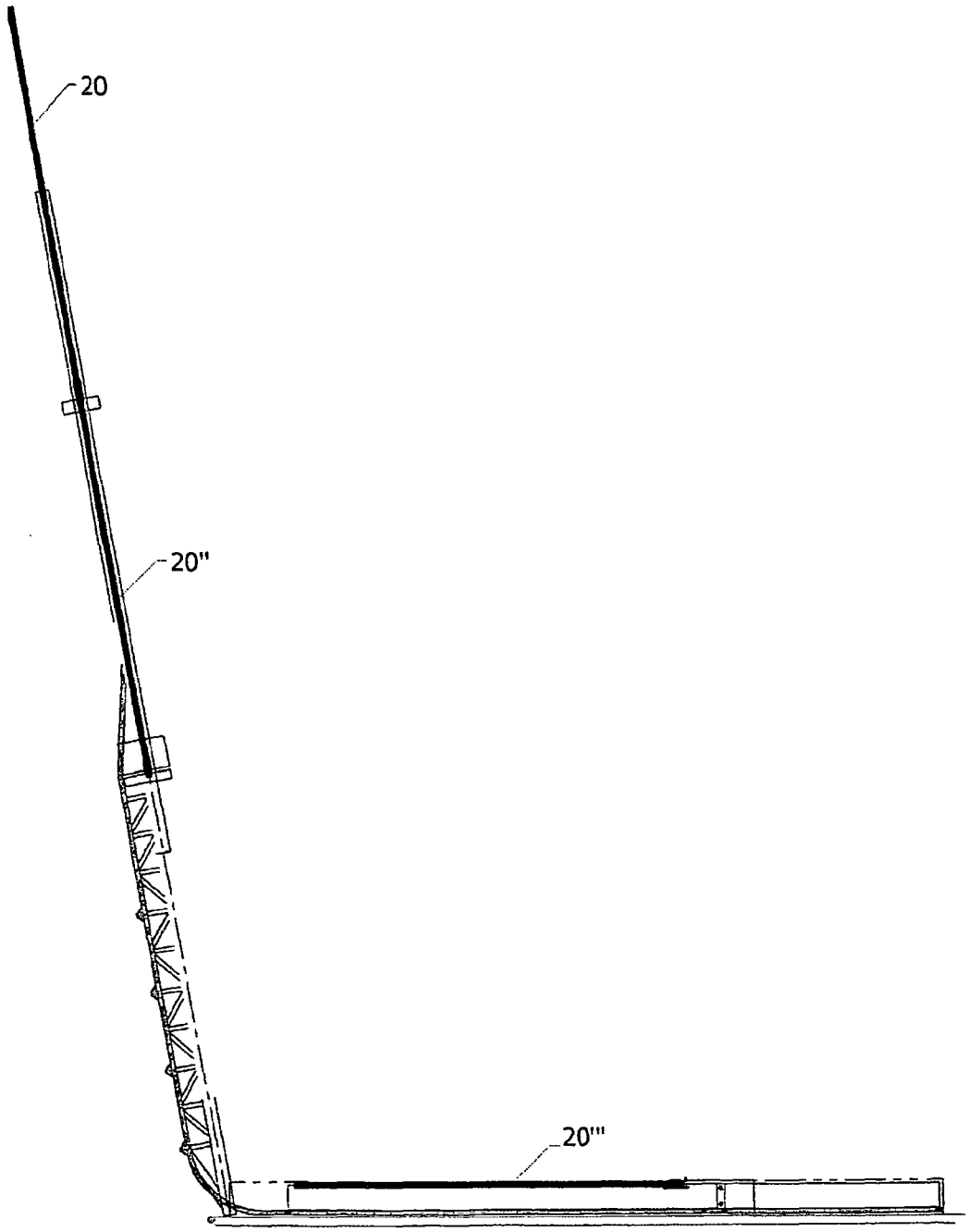
FIG. 21 is the view of FIG. 20 wherein the tubular transport arm has been returned to the horizontal and a third tubular loaded onto the catwalk and advanced onto the inboard end of the tubular transport arm, and wherein the double pipe stand has been elevated so that its lowermost end is within the wrench ready to be made up with the third tubular.

Once skate 32 has translated tubular 20' upwardly through wrench 22 the upper tool joint of tubular 20' is engaged by pipe stand elevator 24 allowing skate 32 to retract downwardly along arm 18 as arm 18 is lowered by winches 82 once again into its horizontal position as seen in FIG. 17 ready for the second tubular 20". As seen in FIG. 18, tubular 20' continues to advance upwardly until its lower tool joint resides in the upper section of wrench 22 awaiting the arrival of the upper tool joint of the second tubular 20". The sequence of elevating arm 18 is then repeated so as to elevate the second tubular 20" to engage the upper tool joint the second of tubular 20" into wrench 22 so as to be mated with the lower tool joint of the first tubular 20' as seen in FIG. 19. The first and second tubulars are screwed together by the spinner associated with wrench 22 and may also for example be optionally torqued by wrench 22 thereby completing make-up of a double pipe stand 8. Skate 32 again advances upwardly once arm 18 is in its fully elevated position with base section 12*a* so as to elevate the double pipe stand upwardly until the pipe stand elevator 24 may engage the made up tool joint between the first and second tubulars, skate 32 thereafter handing off the elevating function to elevator 24 which continues to elevate the double pipe stand from the hand off of FIG. 20 to the position in FIG. 21 wherein the double pipe stand is ready to mate with the third tubular 20''', the lowermost end of the double pipe stand residing in the upper section of wrench 22.

Figure 22:
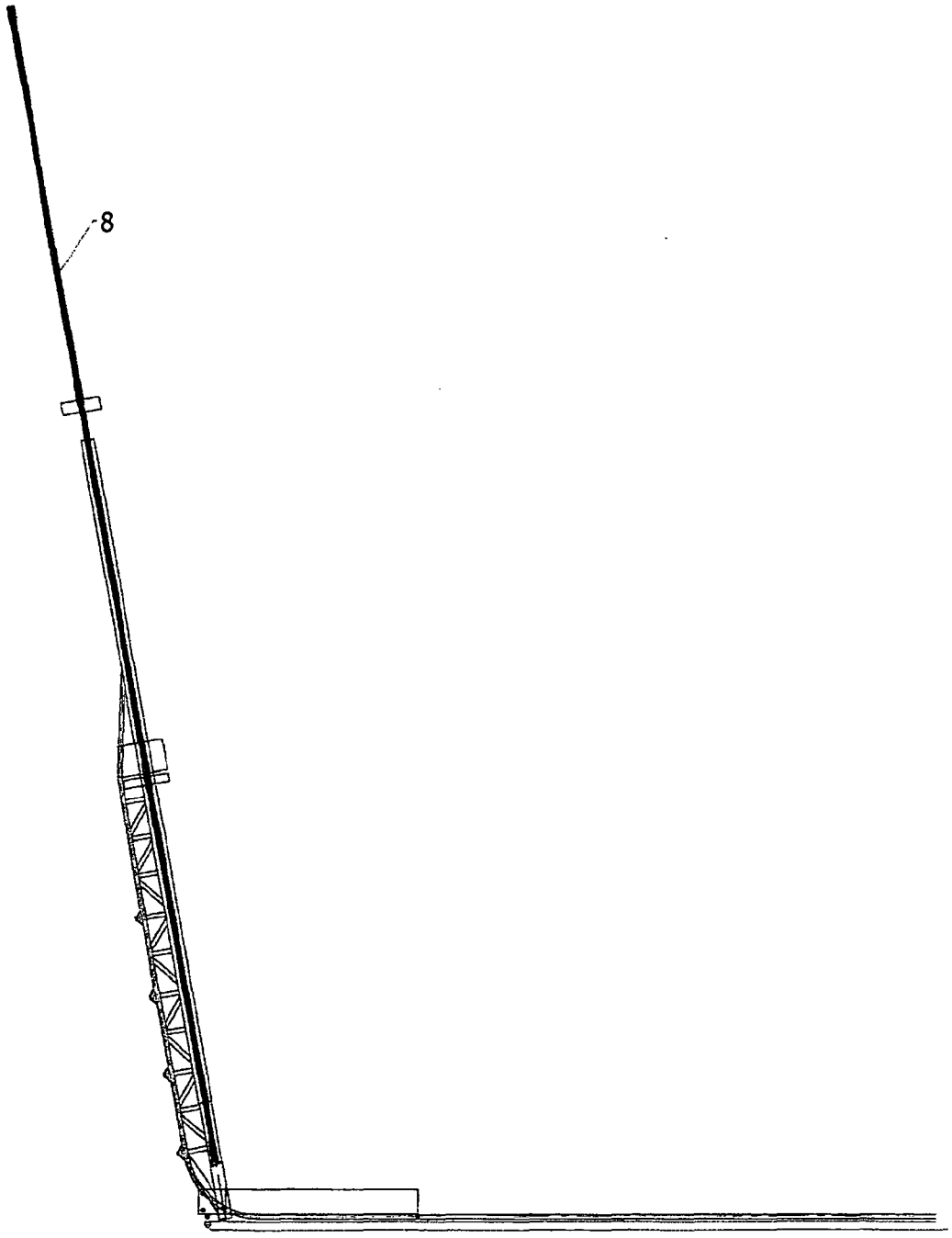
FIG. 22 is the view of FIG. 21 wherein the tubular transport arm is once again elevated to its fully inclined position and the third tubular has been elevated so as to engage its upper end with the lower end of the double pipe stand within the wrench.

The cycle then repeats as arm 18 is lowered to the horizontal and the third pipe stand 20''' is then loaded onto the catwalk from the pipe stands, advanced by skate 32 to the inboard end of arm 18, and arm 18 elevated from the horizontal to the fully inclined position within base section 12*a* whereupon skate 32 continues to advance the third tubular 20''' until its upper end engages into wrench 22 and the spinner and wrench of wrench 22 make up the third tubular 20''' into the pipe stand so as to complete a triple pipe stand as seen in FIG. 22.

Figure 23:
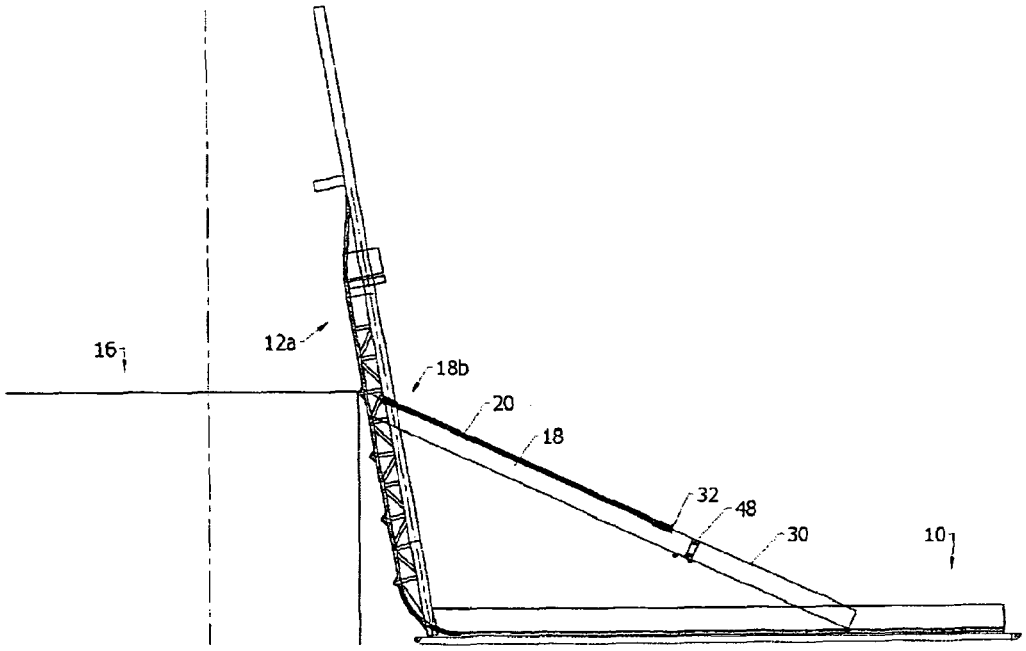
FIG. 23 is a side elevation view of the pipe handling system according to FIG. 13 wherein the tubular transport arm and trolley have been rigidly mounted to one another and wherein the inboard end of the tubular transport arm has been elevated to an intermediary position so as to deliver a single tubular to the floor of the drilling rig substructure.

FIG. 23 illustrates the option provided by arm 18 and trolley 30, when pinned together so that they do not hinge at hinges 48 and thus may be hoisted as a single linear delivery arm. This is useful for hoisting casing, that is, because a length of casing is longer than a length of tubular. If the wrench is repositioned further up the stand-building axis from where it is located for pipe stand building, a double stand of casing may be made up or broken down.

It understood that although the sequence has been described in making up the pipe stands, with the sequence reversed, pipe stands may be broken down so as to return single tubulars to the pipe racks or otherwise for storage once taken off the catwalk.

Figure 31A:
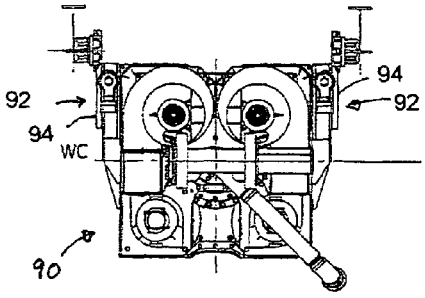
Figure 31B:
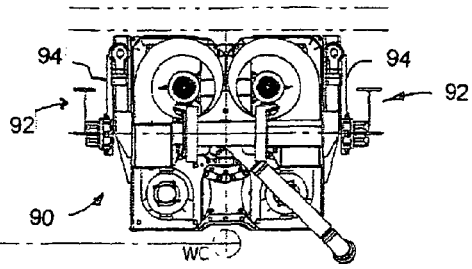
Figure 31C:
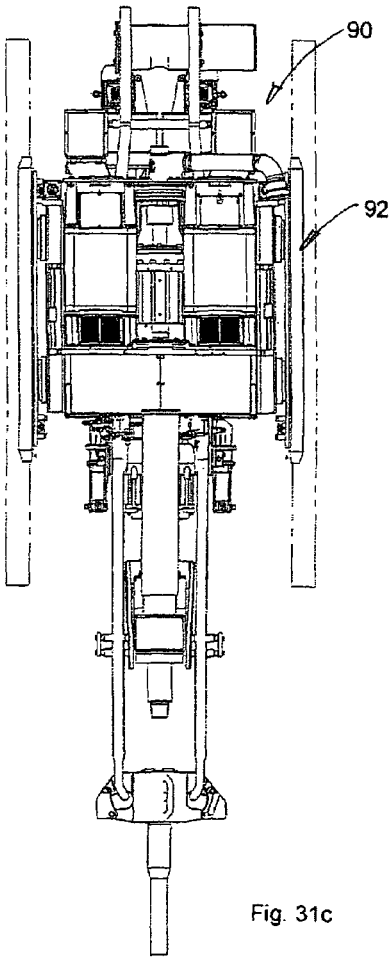
Figure 31D:
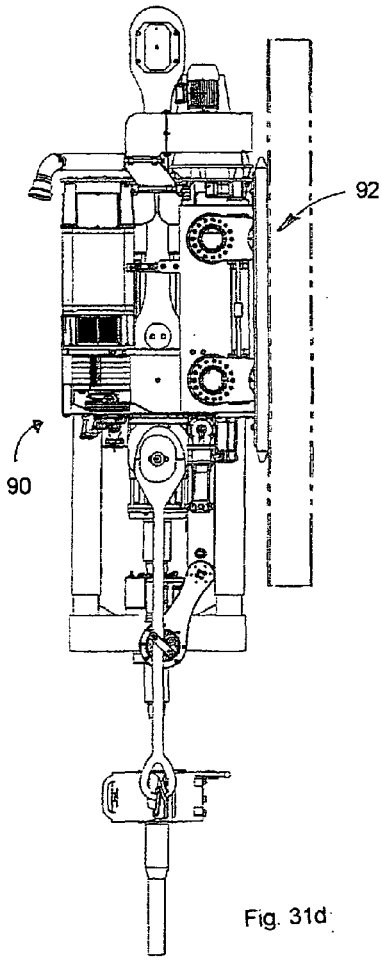

In one embodiment, a top drive retraction system may be provided so that once a pipe stand has been handed off from the top drive elevators to the pipe handling system according to the present invention, during the tripping-out operation the top drive may be returning empty to the rig floor as the pipe stand that has been removed is being either racked or broken down for storage and conversely while tripping-in while the top drive is engaged with the drill string, the pipe handling system according to the present invention may be readying the next pipe stand and positioning it while the top drive is returning empty from the rig floor. The steps for this procedure are set out in tabular form in FIG. 32. One example of a retractable top drive is shown as top drive 90 of FIGS. 30, 31*a*-31*d*. A retractable top drive per se is known in the prior art, such as seen for example in U.S. Pat. No. 5,244,329 and incorporated herein by reference, and as would be known to one skilled in the art. The combination of a retractable top drive with a pipe handling system as described herein, or at least parts thereof, is however a useful improvement. In the top drive 90 illustrated by way of example, a top drive retractor 92, which is not intended to be limiting, moves top drive 90 between the well center-aligned working position of FIG. 31*a* and the retracted position of wall center of FIG. 31*b*. In retractor 92, arms 94 rotated as a parallelogram in direction X to translate the top drive distance twice the length of arms 94 while maintaining the top drive oriented vertically.

Figure 24C:
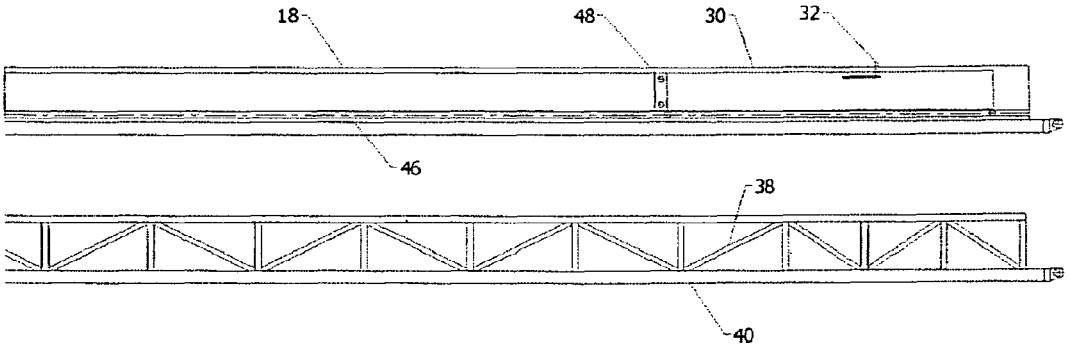
FIG. 24*c* is, in side elevation, the catwalk of FIG. 24*b* showing the catwalk cross-members.
Figure 25:
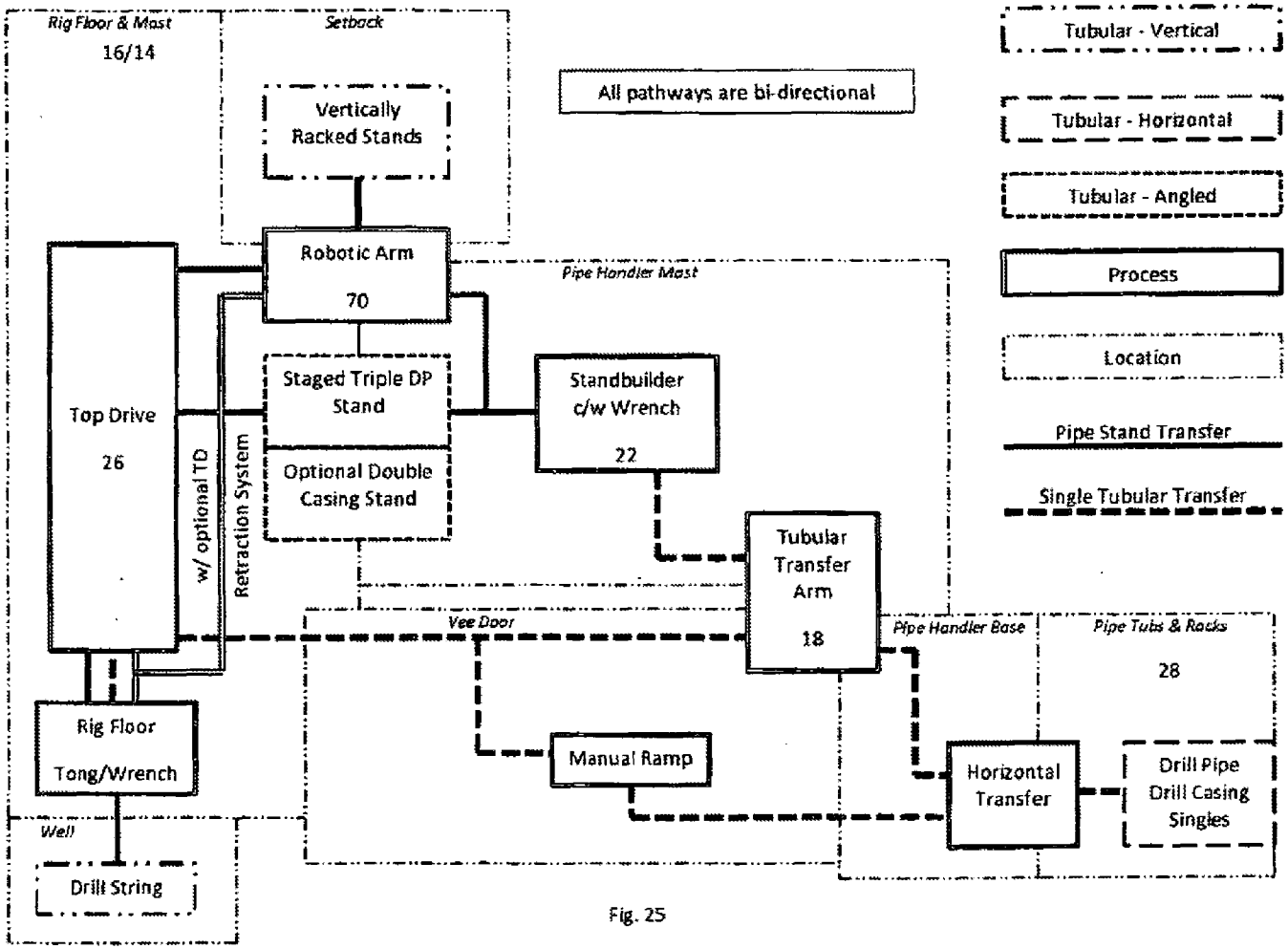
FIG. 25 is a diagrammatic view of the pipe handling system according to one embodiment of the present invention.
Figure 26:
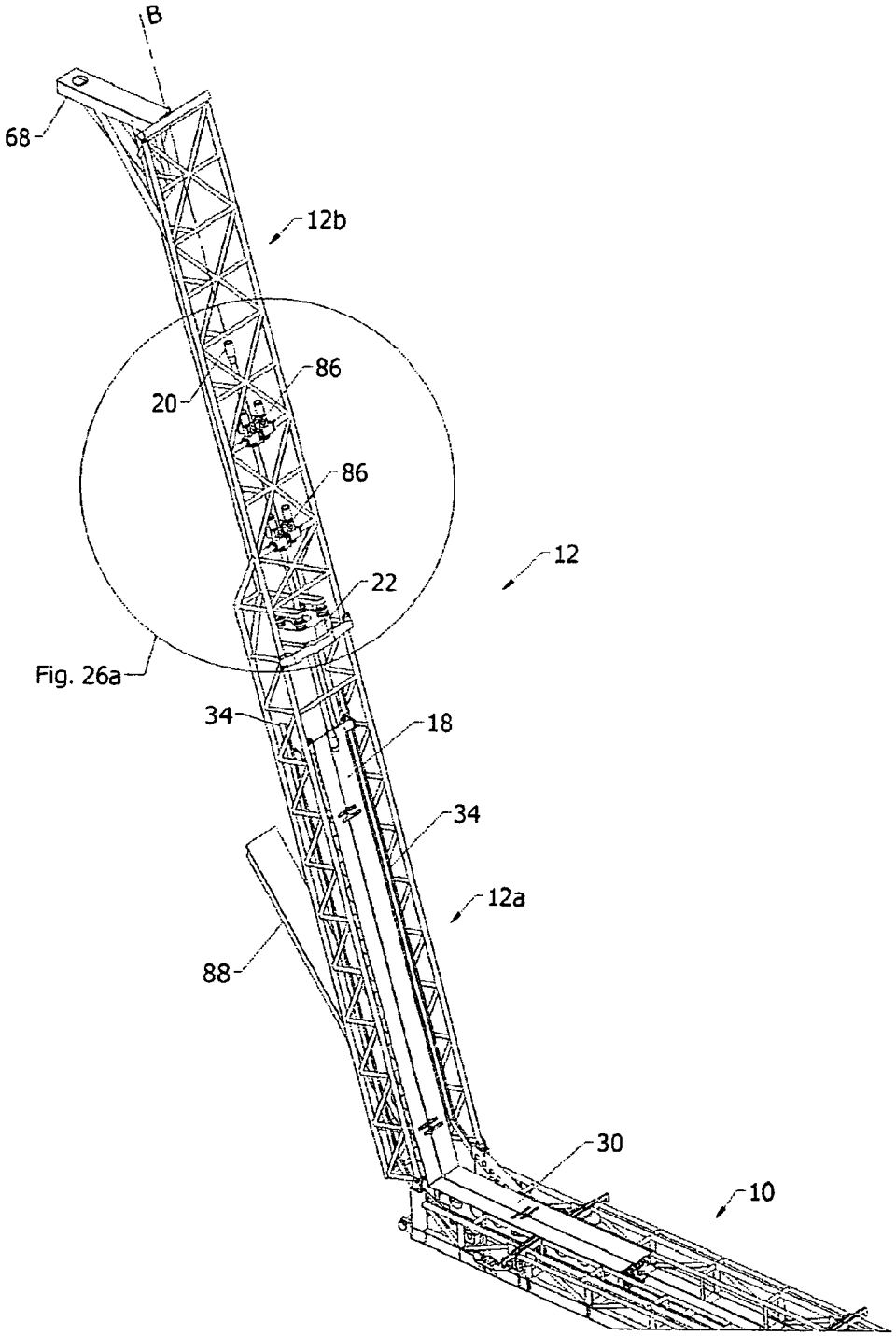
FIGS. 26, 26*a* and 27 onward depict an alternative embodiment wherein a pair of driven "v" rollers are mounted on the stand builder mast above the wrench.
Figure 26A:
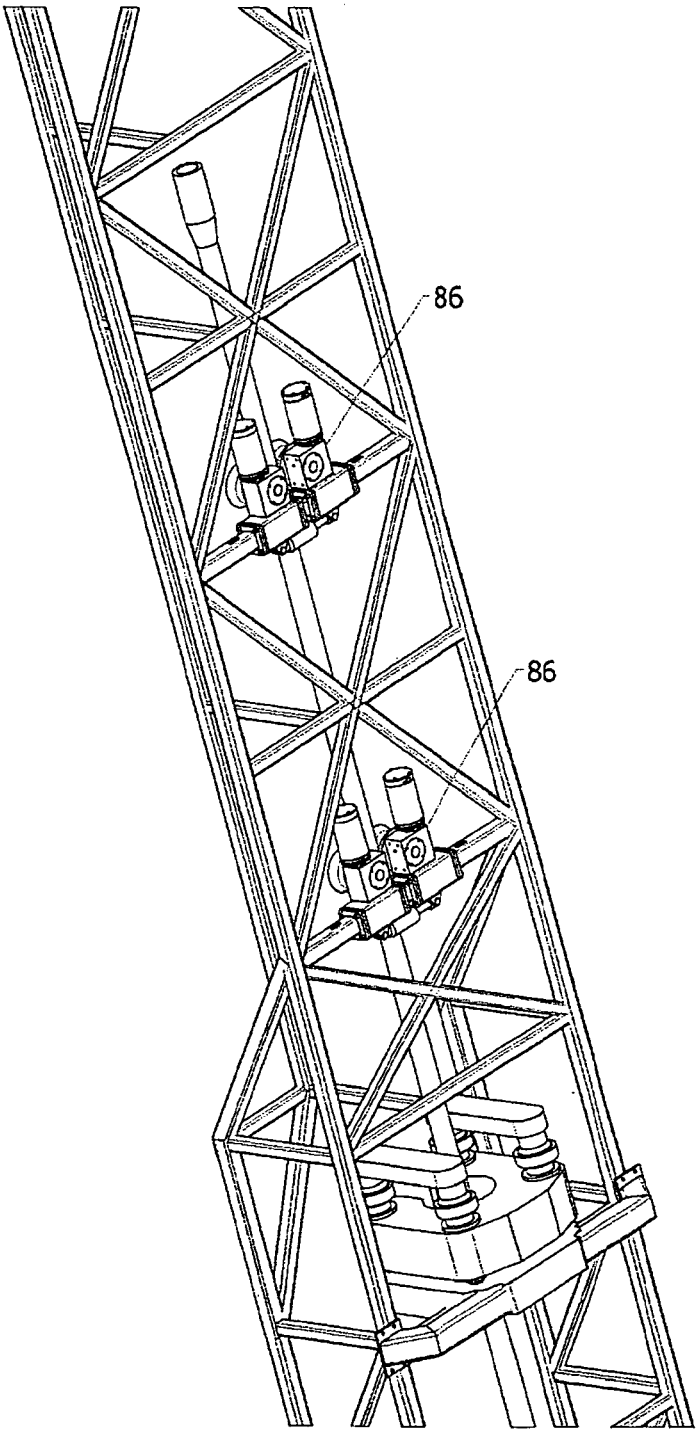
Figure 27:
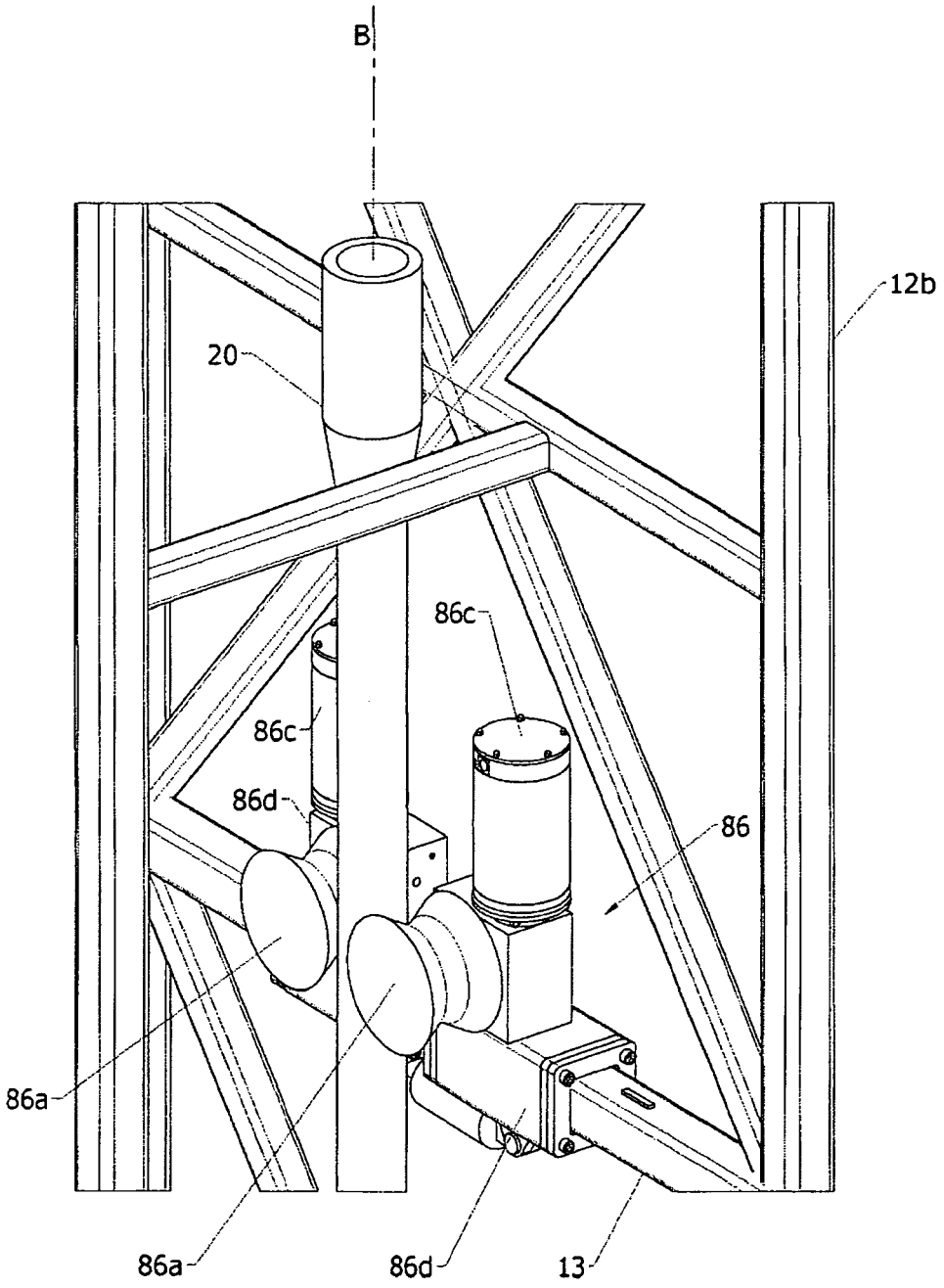
Figure 28:
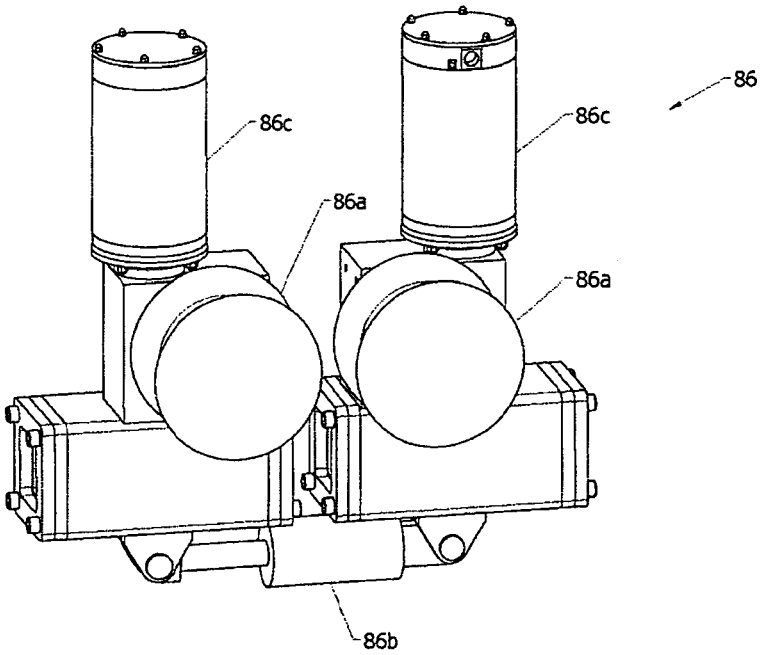
FIG. 28 is a perspective view of a clamping "v" roller assembly.

The various options the drill rig operator will have while employing the portable pipe handling system according to the present invention are set out diagrammatically in FIG. 24 wherein the substantially corresponding part numbers are inserted under the various descriptive titles.

In the above embodiments single tubulars 20 are advanced up the mast 12 using the skate 32 on the tubular transfer arm 18 and then the single tubular 20 is held in the mast by a tubular support 84 or other support arm, etc, while the tubular transfer arm 18 returns to the catwalk 10 to retrieve the next single tubular. The second tubular is then returned to the mast on the tubular transfer arm and advanced up to the wrench 22 for mating with the first tubular. Depending on the length of the single tubulars it may be necessary to upwardly advance the upper single tubular (or double pipe stand if two tubulars have already been made up) along the stand builder mast axis B further than the skate 32 on the arm 18 can push the tubular(s). Consequently, it may be advantageous to mount one or more clamping "v" rollers 86, as an alternative to the use of the elevators 24, in the stand building mast 12, above the wrench in upper section 12*b*, so that the clamping "v" rollers, which include selectively driven rollers 86*a*, may further advance the upper tubular upwardly along the mast upwardly from the wrench. The clamping "v" rollers 86 may be, as illustrated, an opposed pair of driven rollers 86*a*. A pair of clamping "v" rollers 86 may be mounted spaced apart along the upper mast section 12*b* above the wrench. In particular as illustrated two sets of clamping "v" rollers are mounted spaced several feet apart along the stand building axis of trajectory B. This provides selective control over all degrees of freedom of the upper tubular held in the mast. The clamping "v" rollers 86 include clamping cylinders 86*b* so as to engage the rollers 86*a* against the tubular 20 with sufficient force to both hold and lift the weight of the pipe stand 8 by tractive frictional contact alone. "V" rollers 86 include motors 86*c* which may be electric, hydraulic, pneumatic, etc as would be known to one skilled in the art. Cylinders 86*b* move collars 86*d* along cross-bracing member 13 in mast 12 so as to selectively vary distance "d" between the rollers.

Figure 29:
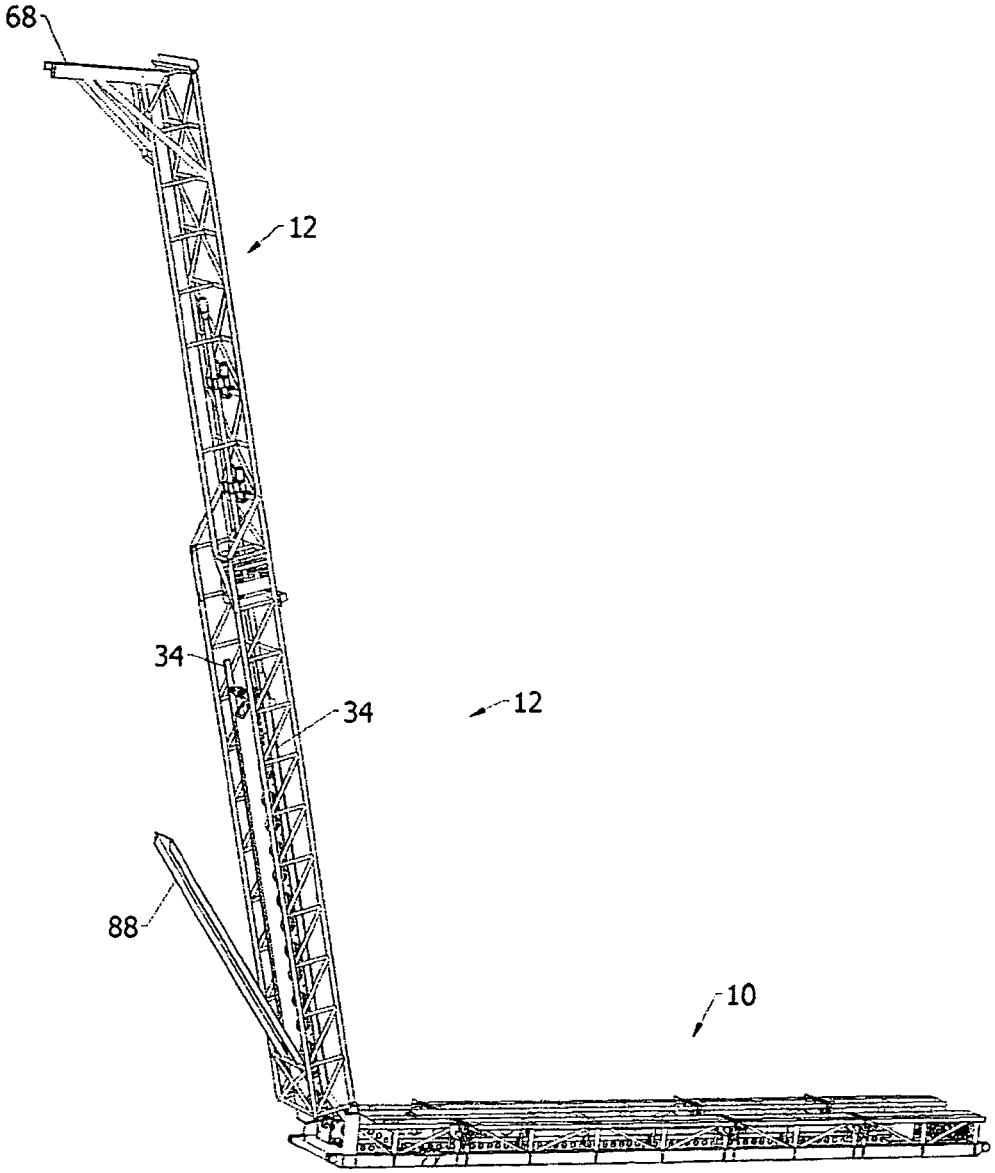
FIG. 29 is a perspective view of a pipe handling system mast comprising a lower ramp.
Figure 30:
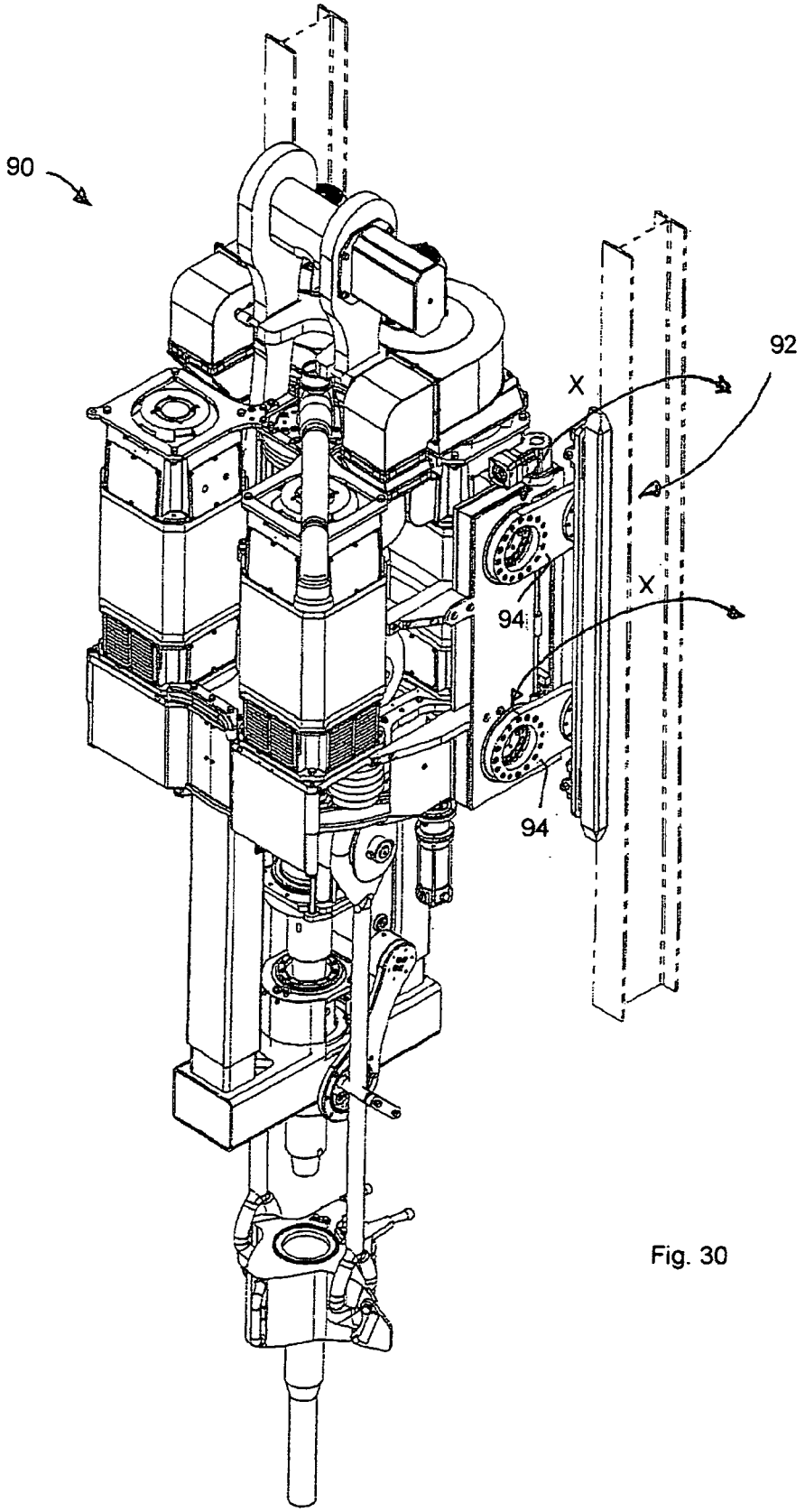
FIGS. 30, 31*a*, 31*b*, 31*c* and 31*d* depict, respectively, a top drive in its extended working position aligned with well center, with the exception of FIG. 31*b* which shows the top drive retracted from well center.

As seen in FIG. 29, a lower ramp 88 may be mounted to the lowermost end of mast 12 so that, if desired, tubulars may be delivered directly from the catwalk onto the floor of the sub-structure 16. Ramp 88 may be selectively inclined to accommodate the positioning of the mast 12 as dictated for example by blow-out preventers mounted along side the sub-structure between the sub-structure and mast. Ramp 88 thus provides conventional access to the v-door of the rig floor.

What is claimed is:

1. A method for pipe handling, the method comprising:

moving a first tubular, by an actuator, onto a support structure configured to support the first tubular in coaxial alignment with an inclined stand-building axis, the stand-building axis oriented at an acute angle to both horizontal and vertical, and non-coaxial to a well center axis of a drill rig adjacent to the support structure, the drill rig comprising a top drive movable along the well center axis and equipped with elevators, the stand-building axis angling upwardly toward the well center axis through a hand-off window within which the elevators of the top drive are positionable to engage a pipe stand comprising the first tubular;

bringing a second tubular, by the actuator, onto the support structure and into coaxial alignment with the stand-building axis; and, while both the first and second tubulars remain on the support structure and in alignment with the stand-building axis, coupling the first and second tubulars together to yield the pipe stand by rotating the first and second tubulars relative to one another using a joint thread rotator; and translating the pipe stand along the inclined stand-building axis, by a pipe stand holder on the support structure, until the pipe stand intersects the hand-off window.

2. A method according to claim 1 further comprising bringing a third tubular onto the support structure and into coaxial alignment with the stand-building axis and, while the first, second, and third tubulars remain in coaxial alignment with the stand-building axis on the support structure, coupling the third tubular to the first and second tubulars by rotating the third tubular relative to the first and second tubulars.

3. A method according to claim 2 wherein the pipe stand comprising the first, second, and third tubulars has a length of over 90 feet.

4. A method according to claim 3 wherein the inclination of the stand-building axis is adjustable.

5. A method according to claim 1 wherein moving the first tubular into alignment with the stand-building axis comprises placing the first tubular on a generally horizontal trolley and advancing the trolley toward the support structure until the first tubular and the trolley are aligned with the stand-building axis.

6. A method according to claim 5 wherein the trolley comprises a transport arm pivotally mounted at an end thereof and the method comprises delivering the first tubular to the trolley and subsequently, while the transport arm is aligned with the trolley, advancing the first tubular onto the transport arm.

7. A method according to claim 6 wherein bringing the first tubular into coaxial alignment with the stand-building axis comprises advancing the trolley and thereby causing the transport arm to pivot relative to the trolley and translate along the support structure until the transport arm is extending generally parallel to the stand-building axis, thereby carrying the tubular into coaxial alignment with the stand-building axis.

8. A method according to claim 1 wherein the stand-building axis is at an angle of 5 to 25 degrees to vertical.

9. A method according to claim 1 wherein the joint thread rotator comprises a wrench comprising a rotating spinner section and a backup jaw is located along the stand-building axis, wherein coupling the first and second tubulars together comprises gripping one of the first and second tubulars in the backup jaw and the other one of the first and second tubulars in the spinner section of the wrench and then rotating the spinner section relative to the backup jaw so as to make up a tool joint between the first and second tubulars.

10. A method according to claim 9 comprising advancing the first and second tubulars along the stand-building axis after coupling the first and second tubulars together.

11. A method according to claim 10 wherein advancing the tubulars along the stand-building axis comprises gripping the tubulars between clamping "V" rollers and driving the "V" rollers to advance the first and second tubulars upwardly along the stand-building axis relative to the wrench.

12. A method according to claim 1 comprising, while the first and second tubulars remain coaxially aligned with the stand-building axis, engaging an upper end of the connected first and second tubulars to the elevators.

13. A method according to claim 1 comprising grasping the pipe stand comprising the first and second tubulars with a gripper supported on a robotic arm and operating the robotic arm to transfer the pipe stand to the elevators of the top drive of the drill rig.

14. A method according to claim 1 further comprising gripping the pipe stand with a gripper of a robotic arm and lifting the pipe stand using the robotic arm.

15. A method according to claim 1 wherein moving the first tubular into coaxial alignment with the stand-building axis comprises transferring the first tubular in a substantially horizontal orientation onto a movable support, and advancing the movable support toward the drill rig such that a leading end of the movable support is driven up a ramp of the support structure, until the tubular is oriented parallel to the stand-building axis.

16. A method according to claim 15 wherein the movable support is pivotally attached to a movable trolley and transferring the tubular onto the moveable support occurs when the movable support is aligned with the trolley.

17. A method according to claim 16 wherein, when the moveable support is driven up the ramp, the trolley remains horizontal.

18. A method according to claim 1 wherein a pipe stand joint thread rotator is provided on the support structure and coupling the first and second tubulars together comprises rotating one of the first and second tubulars about the stand-building axis using the pipe stand joint thread rotator.

19. A method according to claim 18 wherein the pipe stand joint thread rotator comprises a wrench, tong, or spinner.

20. A method according to claim 1 wherein the stand-building axis intersects with the well center axis.

21. A method according to claim 20 comprising engaging a stand comprising the first and second tubulars using the elevators wherein the method also comprises maintaining the first tubular clear of the well center axis until after the stand has been engaged by the elevators.

22. A method according to claim 1 comprising supporting a lower end of the first tubular, to maintain the first tubular in alignment with the inclined pipe stand-building axis, with a tubular support while coupling the first and second tubulars together.

23. A method according to claim 1 comprising, after coupling the first and second tubulars together, coupling the first and second tubulars to a drill string, the drill string co-axial with the well center axis.

* * * * *